US005841402A

United States Patent [19]

Dias et al.

[11] Patent Number: 5,841,402

[45] **Date of Patent: *Nov. 24, 1998**

[54] ANTENNA MEANS FOR HAND-HELD RADIO DEVICES

[75] Inventors: Daniel R. Dias, Cedar Rapids; Robert J. Kraus, Vinton; Guy J. West, Cedar Rapids; William T. Gibbs, Cedar Rapids; Patrick H. Davis, Cedar Rapids; Bradley E. Eckley, Cedar Rapids; Richard C. Arensdorf, Ely; James R. Hutton, Cedar Rapids, all of Iowa

[73] Assignee: Norand Corporation, Cedar Rapids, Iowa

[ * ] Notice: The term of this patent shall not extend beyond the expiration date of Pat. No. 5,555,459.

[21] Appl. No.: 711,287

[22] Filed: Sep. 9, 1996

Related U.S. Application Data

[63] Continuation of Ser. No. 19,481, Feb. 18, 1993, Pat. No. 5,555,459, which is a continuation-in-part of Ser. No. 859, 510, Mar. 27, 1992.

[51] Int. Cl.[6] ..... H01Q 1/24

[52] U.S. Cl. ..... 343/702; 343/872; 455/90

[58] Field of Search ..... 343/702, 872, 343/873, 700 MS; 455/89, 90

[56] References Cited

U.S. PATENT DOCUMENTS

| | | | |
|---|---|---|---|
| 4,471,493 | 9/1984 | Schober | 343/702 |
| 4,571,595 | 2/1986 | Phillips et al. | 343/702 |
| 4,577,195 | 3/1986 | Schwanitz et al. | 343/702 |
| 4,728,962 | 3/1988 | Kitsuda et al. | 343/872 |
| 4,803,491 | 2/1989 | Hikuma | 343/702 |
| 4,829,591 | 5/1989 | Hashimoto et al. | 343/702 |
| 4,894,663 | 1/1990 | Urbish et al. | 343/702 |
| 4,955,084 | 9/1990 | Umetsu et al. | 343/702 |
| 4,980,694 | 12/1990 | Hines | 343/702 |
| 5,227,804 | 7/1993 | Oda | 343/720 |
| 5,258,892 | 11/1993 | Stanton et al. | 343/702 |
| 5,337,061 | 8/1994 | Pye et al. | 343/702 |
| 5,555,459 | 9/1996 | Kraus et al. | 343/702 |
| 5,657,028 | 8/1997 | Sanad | 343/702 |

*Primary Examiner*—Hoanganh T. Le
*Assistant Examiner*—Tan Ho
*Attorney, Agent, or Firm*—Zarley, McKee,Thomte, Voorhees & Sease

[57] ABSTRACT

An antenna for a hand-held RF transceiver terminals includes an antenna element which is encapsulated by material which does not detrimentally effect its antenna performance, but which closely conforms the antenna to the general shape of the terminal without having the antenna extend directly from the terminal.

29 Claims, 20 Drawing Sheets

ANTENNA RADIATION PATTERN

ANTENNA RADIATION PATTERN

ANTENNA RADIATION PATTERN

ANTENNA MEANS FOR HAND-HELD RADIO DEVICES

CROSS REFERENCE TO RELATED APPLICATIONS

The present application is a continuation of Ser. No. 08/019,481 filed Feb. 19, 1993 now U.S. Pat. No. 5,555,459, which is a continuation-in-part of the following co-pending application:

| U.S. Ser. No. | Filing Date | Inventor(s) |
|---|---|---|
| 07/859,570 | 3/27/92 | R. Kraus<br>K. Shoemaker |

Reference is made to the following related applications (pursuant to 35 U.S.C. §120):

CO-PENDING RELATED APPLICATIONS

| U.S. Ser. No. | Filing Date | Inventor(s) |
|---|---|---|
| 07/426,135 | 10/24/89 | G. Hanson |
| 07/660,615 | 2/25/91 | S. Koenck<br>P. Miller<br>G. Hanson<br>J. Krunnfusz<br>D. Schultz |
| 07/966,907 | 10/26/92 | D. Main<br>T. Kassens |
| | 12/23/92 | G. West<br>C. Gollnick<br>R. Luse<br>R. Mahany |
| 07/960,520 | 10/13/92 | G. Hanson |
| 07/777,393 | 12/6/91 | S. Koenck<br>P. Miller<br>A. Danielson<br>R. Mahany<br>D. Durbin<br>K. Cargin<br>G. Hanson<br>D. Schultz<br>R. Geers<br>D. Boatwright<br>W. Gibbs<br>S. Kelly |
| | 35 U.S.C. §102(e) date: 1/7/92) | |

EARLIER RELATED APPLICATIONS

| U.S. Ser. No. | Filing Date | Inventor(s) |
|---|---|---|
| PCT/US 90/03282 | 6/7/90 | S. Koenck<br>P. Miller<br>A. Danielson<br>R. Mahany<br>D. Durbin<br>K. Cargin<br>G. Hanson<br>D. Schultz<br>R. Geers<br>D. Boatwright<br>W. Gibbs<br>S. Kelly |
| 07/735,610 | 7/23/91 | G. Hanson |
| 07/777,691 | 10/10/91 | G. Hanson |
| 07/786,802 | 11/5/91 | G. Hanson |
| 07/820,070 | 1/10/92 | G. Hanson |
| 07/835,718 | 2/12/92 | S. Koenck<br>P. Miller |

-continued

| U.S. Ser. No. | Filing Date | Inventor(s) |
|---|---|---|
| PCT/US 92/01461 | 2/25/92 | S. Koenck<br>P. Miller<br>G. Hanson<br>D. Schultz<br>J. Krunnfusz |
| 07/881,096 | 5/11/92 | G. Hanson |
| 07/912,917 | 7/13/92 | G. Hanson |
| | 7/23/92 | G. Hanson |
| 07/321,932 | 3/9/89 | D. Main<br>T. Kassens |
| 07/982,292 | 11/27/92 | G. West<br>C. Gollnick<br>R. Luse |

Reference is made to each of the foregoing copending and related applications in accordance with the provisions of 35 U.S.C. § 120.

Incorporation By Reference

The contents of each of the foregoing co-pending and related applications (including Ser. No. 07/859,570) now abandoned including drawings and appendices is hereby incorporated herein by reference in its entirety.

BACKGROUND OF THE INVENTION a. Field of the Invention

The present invention relates to antennas for radio frequency devices, and in particular, to such antennas for hand-held data terminals which utilize radio frequency transceivers.

b. Problems in the Art

Hand-held, easily portable data terminals are becoming increasingly popular. Similarly, wireless communication, for example, via radio frequency transmissions, is utilized with many of these types of devices. Such communication allows easy and advantageous communication of information from a small portable terminal to a larger remotely positioned computer or other device and, conversely, allows information from the remote terminal or base to be instantaneously conveyed to a remote hand-held terminal.

Radio communication requires a radiating element or antenna. Conventionally, antennas for hand-held terminals take the form of a small helically wound stub antenna. Such antennas provide an adequate range and reception and are preferred because their small size matches the small, hand-held size of the terminal.

Problems and deficiencies do exist with such stub antennas, however. They generally extend from the terminal housing and therefore are susceptible to contact and breakage. Also, the mere fact that they extend the outer dimensions of the terminal conflicts with the attempt to make terminals as small as possible. The mere physical presence of the stub antenna also limits placement of these devices in cooperating devices such as recharging cradles, data download mounts, and other accessories.

It would therefore be beneficial if the need for an external, outwardly extending stub-type antenna were eliminated. It is therefore a primary object of the present invention to provide a means which solves the problems and eliminates deficiencies in the art.

A further object of the present invention is to provide a means which provides an antenna which performs generally as well or better than a conventional helical stub antenna, but eliminates the antenna from having to extend outwardly from the terminal container and be subject to damage or breakage.

A further object of the present invention is to provide a means as above described which conforms generally closely to the housing of the hand-held terminal or is entirely internally contained within the hand-held terminal.

Another object of the present invention is to provide a means as above described which does not physically cause interference between the primary perimeter of the hand-held terminal and such things as recharging or data communications connection cradles.

A still further object of the present invention is to provide a means as above described which utilizes materials and positioning which renders the antenna generally omnidirectional in performance, while shielding it from direct physical contact.

Another object of the present invention is to provide a means as above described which can be placed to minimally impact upon size or placement of components, connections, and ports with respect to the housing and terminal and its normal operation.

These and other objects, features, and advantages of the present invention will become more apparent with reference to the accompanying specification and claims.

SUMMARY OF THE INVENTION

The present invention improves upon the art by eliminating the requirement for a stub helical antenna or other generally linear-type extending antennas. The invention utilizes a radiating element which is substantially encapsulated with a material which does not materially effect its radiating and receiving performance properties, but protects it from direct contact during use of the hand-held terminal, and places the radiating element entirely inside the housing of the hand-held terminal, substantially in conformance with the exterior of the housing, or in a modular portion thereof.

The invention also utilizes connection means to the transceiving component in the terminal which effectively establishes an electrical connection between the transceiving component and the radiating element. The invention also is conformed to the specific size and shape constraints of the housing so that it minimally, if at all, represents an extension, addition, or variance from the general size and shape of the terminal housing.

The invention also utilizes materials associated with the radiating element which do not materially degrade the performance of the radiating element in terms of transmission and reception, or in terms of electrical interference with other components of the terminal.

The invention can be used with a wide range of products and eliminates the inherent problems with a stub-type antenna.

These and other objects, features, and advantages of the invention will become more apparent with reference to the accompanying specification and claims.

BRIEF DESCRIPTION OF THE DRAWINGS

FIG. 1 illustrates a prior art utilization of a stub antenna as a radiating element for radio frequency communications.

FIG. 22 is a diagrammatic depiction of a hand-held terminal of FIG. 20 in a connection cradle with a device such as a computer, battery charger, or the like.

Figure 1:
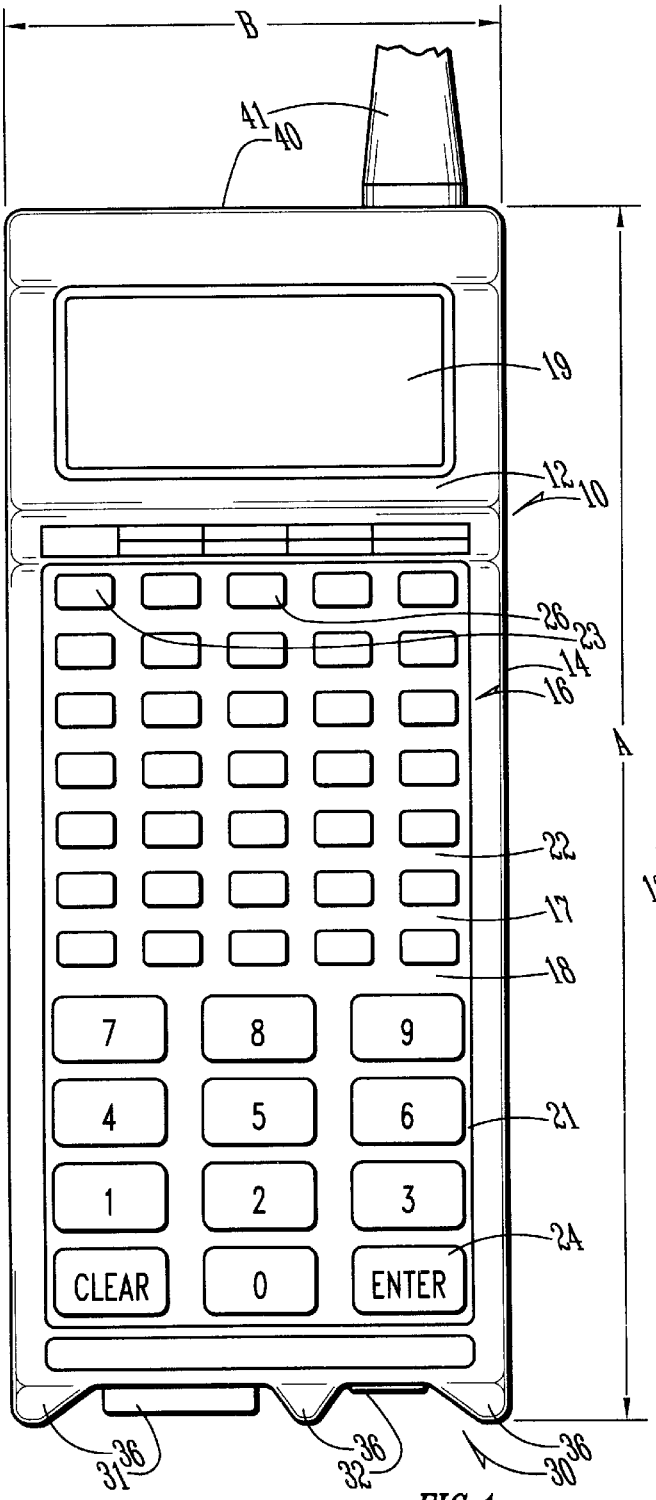
FIG. 1 is a top plan view of an embodiment of a hand-held terminal with which the present invention can be utilized.

DETAILED DESCRIPTION OF THE PREFERRED EMBODIMENT a. Overview

To assist in a better understanding of the invention, a description of different forms and embodiments of the invention will now be described in detail. Reference will be made to the accompanying drawings. Reference numbers and letters will be used in the drawings to indicate specific parts and locations on the drawings. The same reference numerals and letters will be used throughout the drawings unless otherwise indicated.

It is to be understood that the scope of the invention is not limited to the specific embodiments discussed herein.

b. FIGS. 1–12

FIGS. 1–12 illustrate a specific example of the invention. A hand-held terminal 10 is fittable with removable modules. Examples are module 48 of FIG. 2 and module 51 of FIG. 3.

Figure 4:
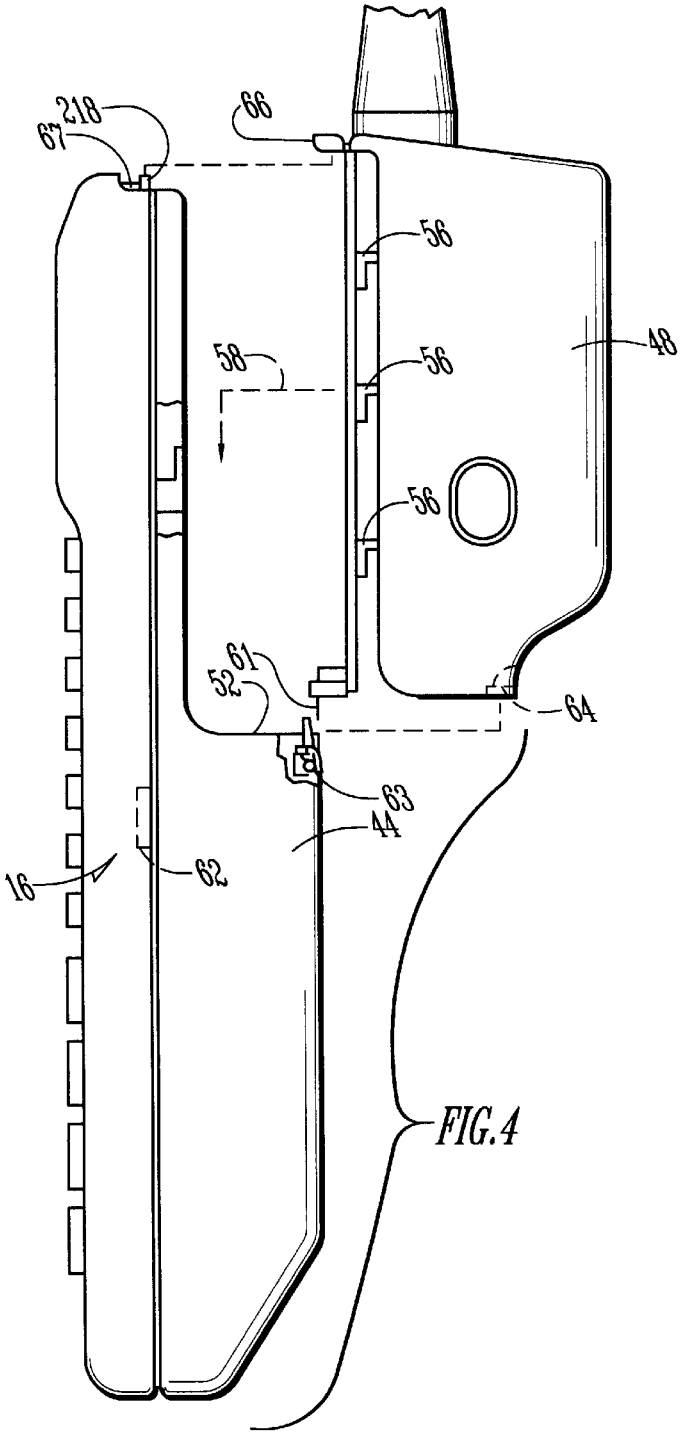
FIG. 4 is essentially similar to FIG. 2 but showing the modular component similar to that shown in FIG. 2 removed from the main terminal housing, including the helical stub antenna on the modular unit.
Figure 5:
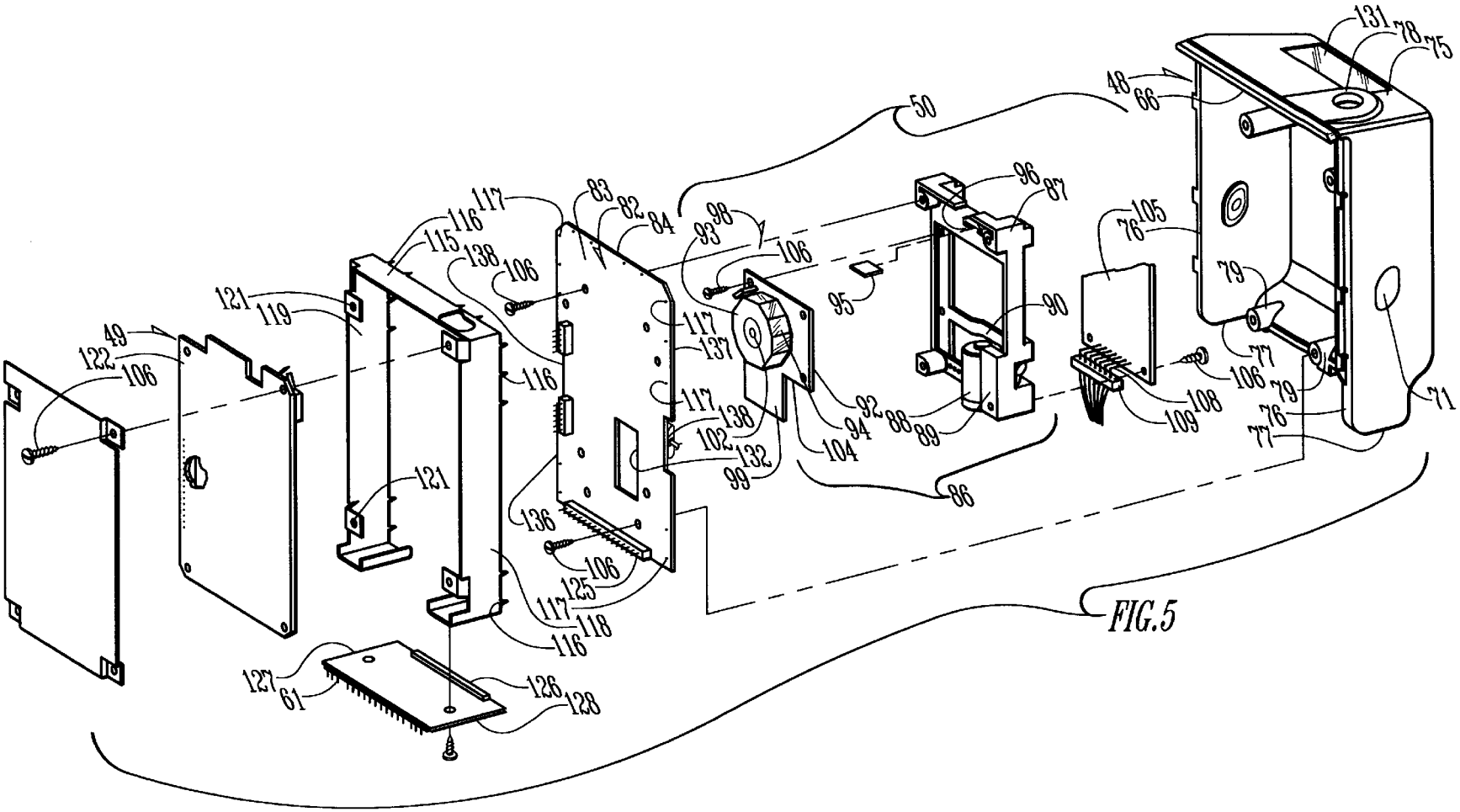
FIG. 5 is an exploded view of the modular unit of FIG. 2 without the stub antenna attached.
Figure 6:
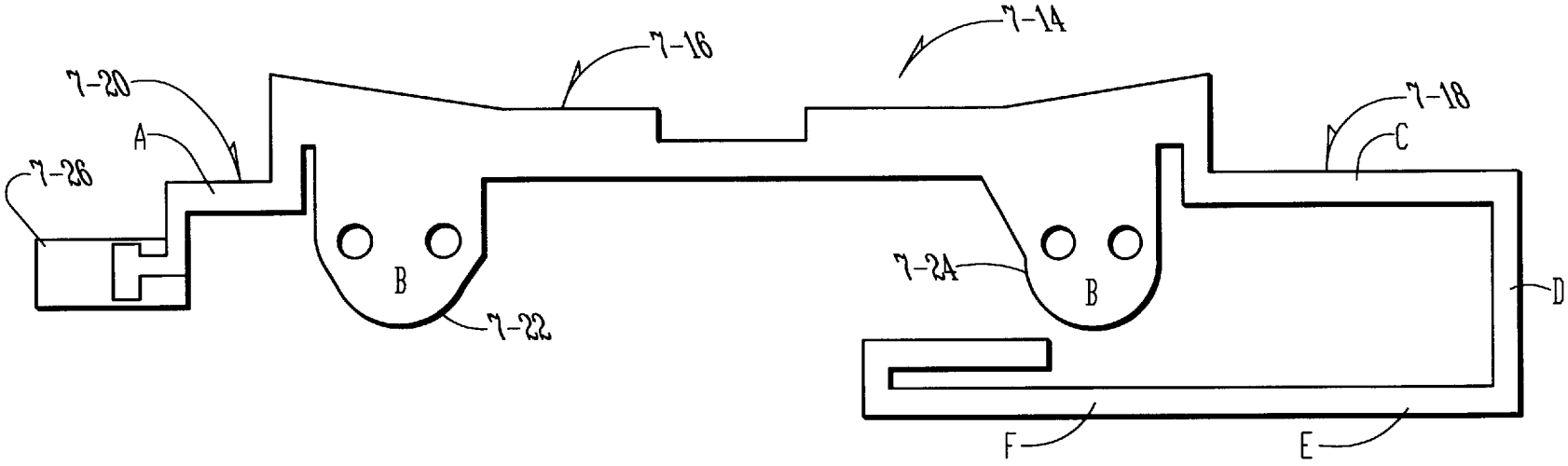
FIG. 6 is a top plan view of one embodiment of a radiating element according to the present invention in an unconformed state to the terminal housing or modular component of the terminal.
Figure 7:
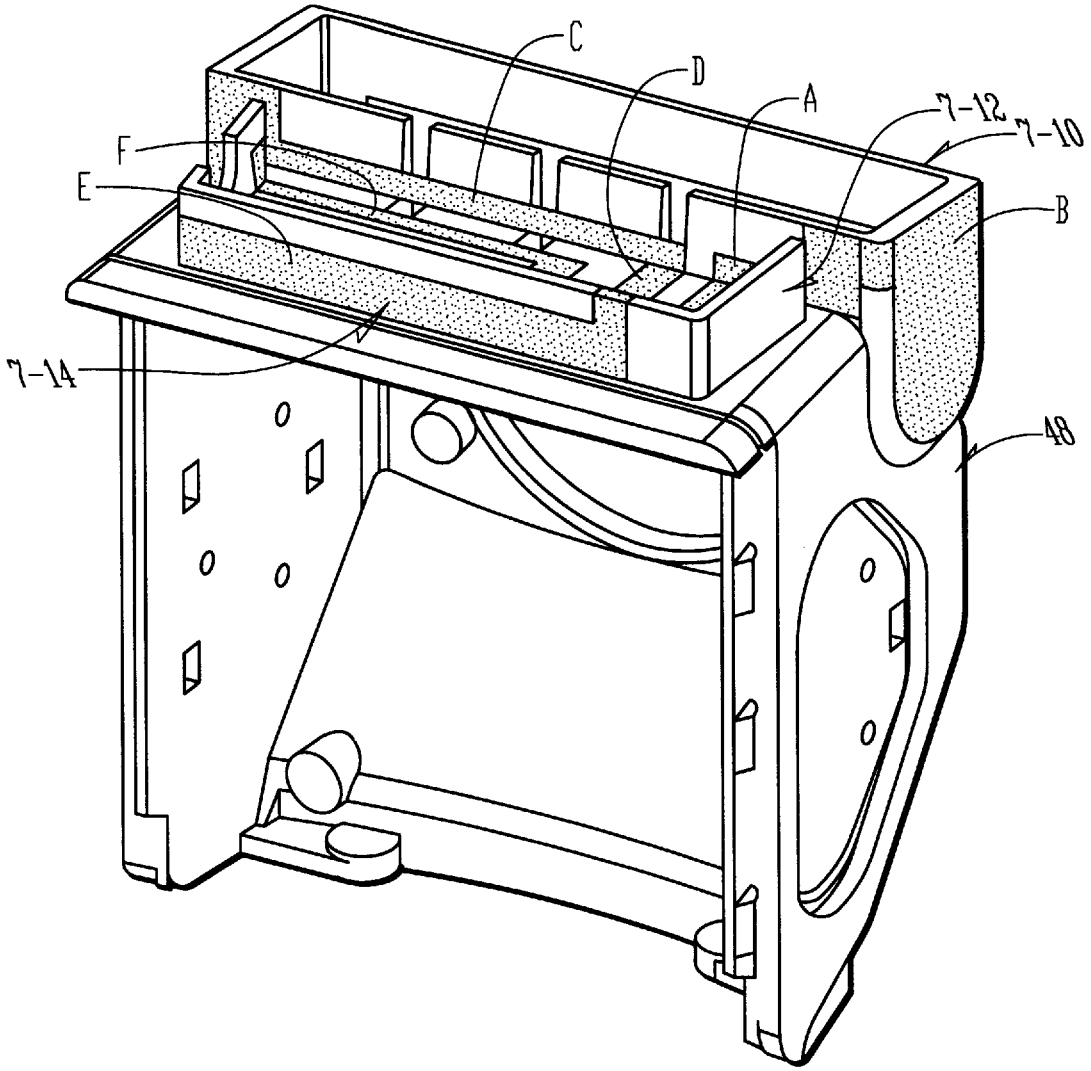
FIG. 7 is an isolated perspective view of a frame of a modular add-on to a terminal such as FIG. 1 with the radiating element of FIG. 6 conformally placed in position.
Figure 8:
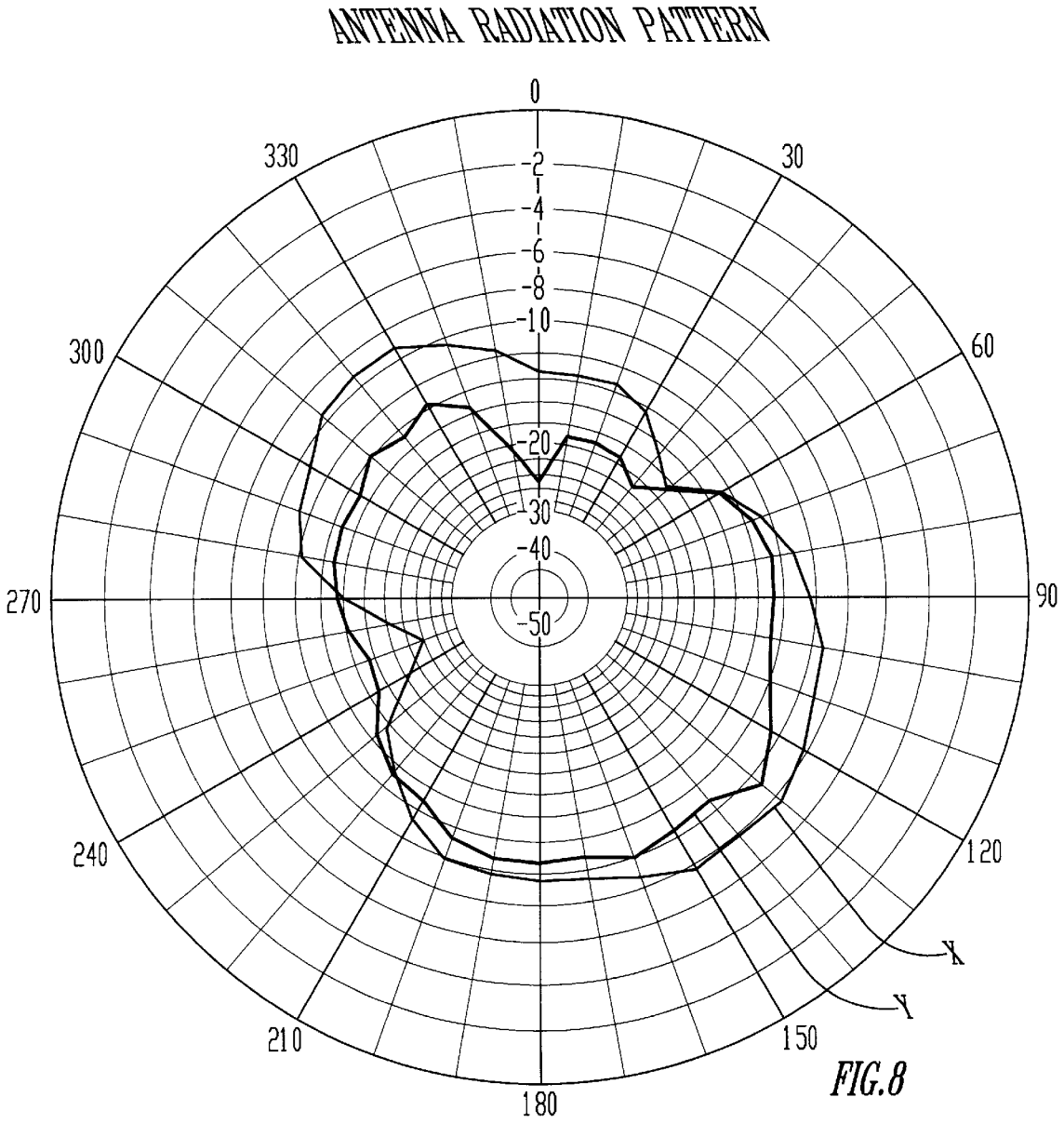
FIGS. 8–12 are antenna radiation patterns comparing the performance of radiating element of FIG. 7 with a conventional helical stub antenna such as shown in FIG. 1.
Figure 9:
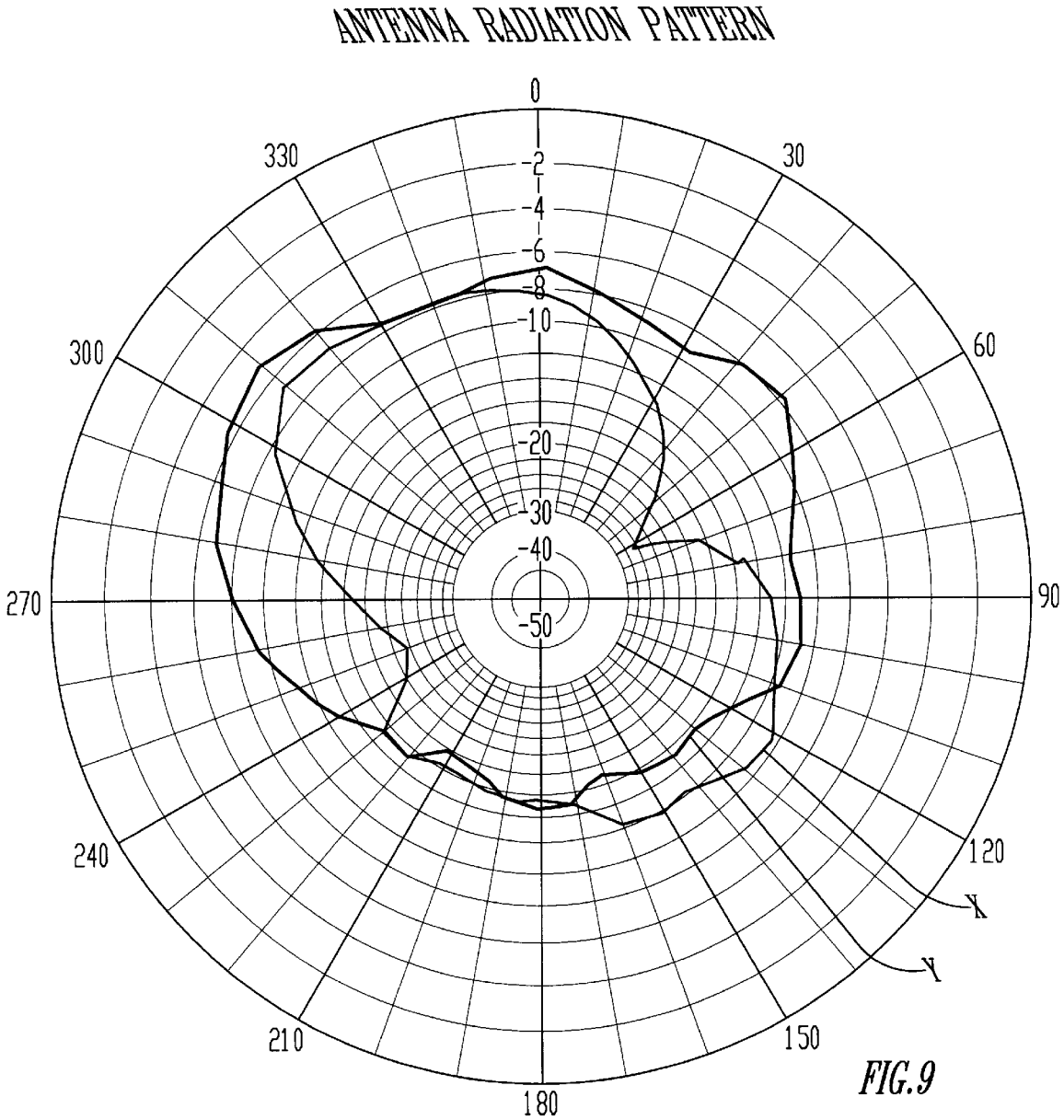
Figure 10:
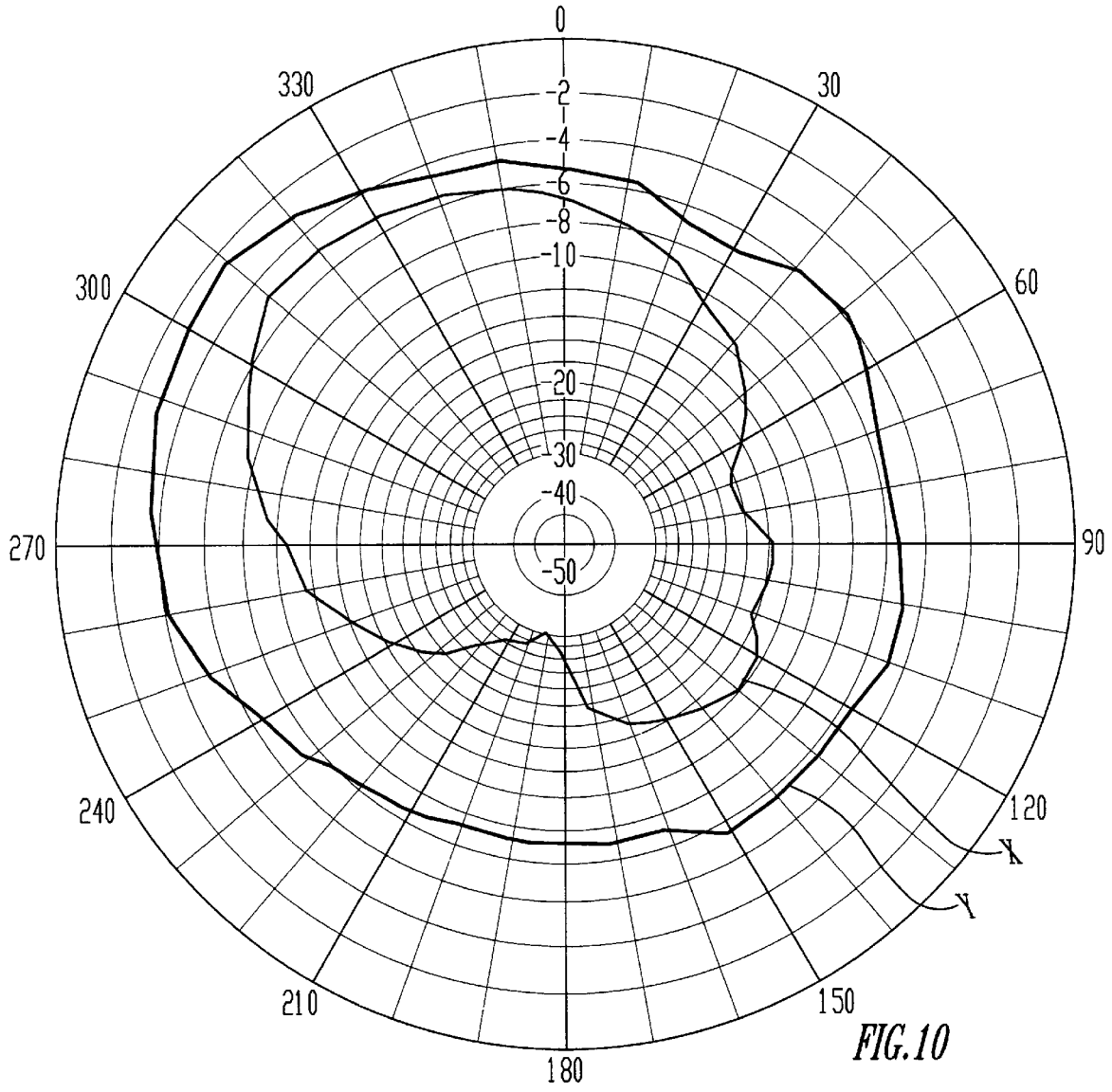
Figure 11:
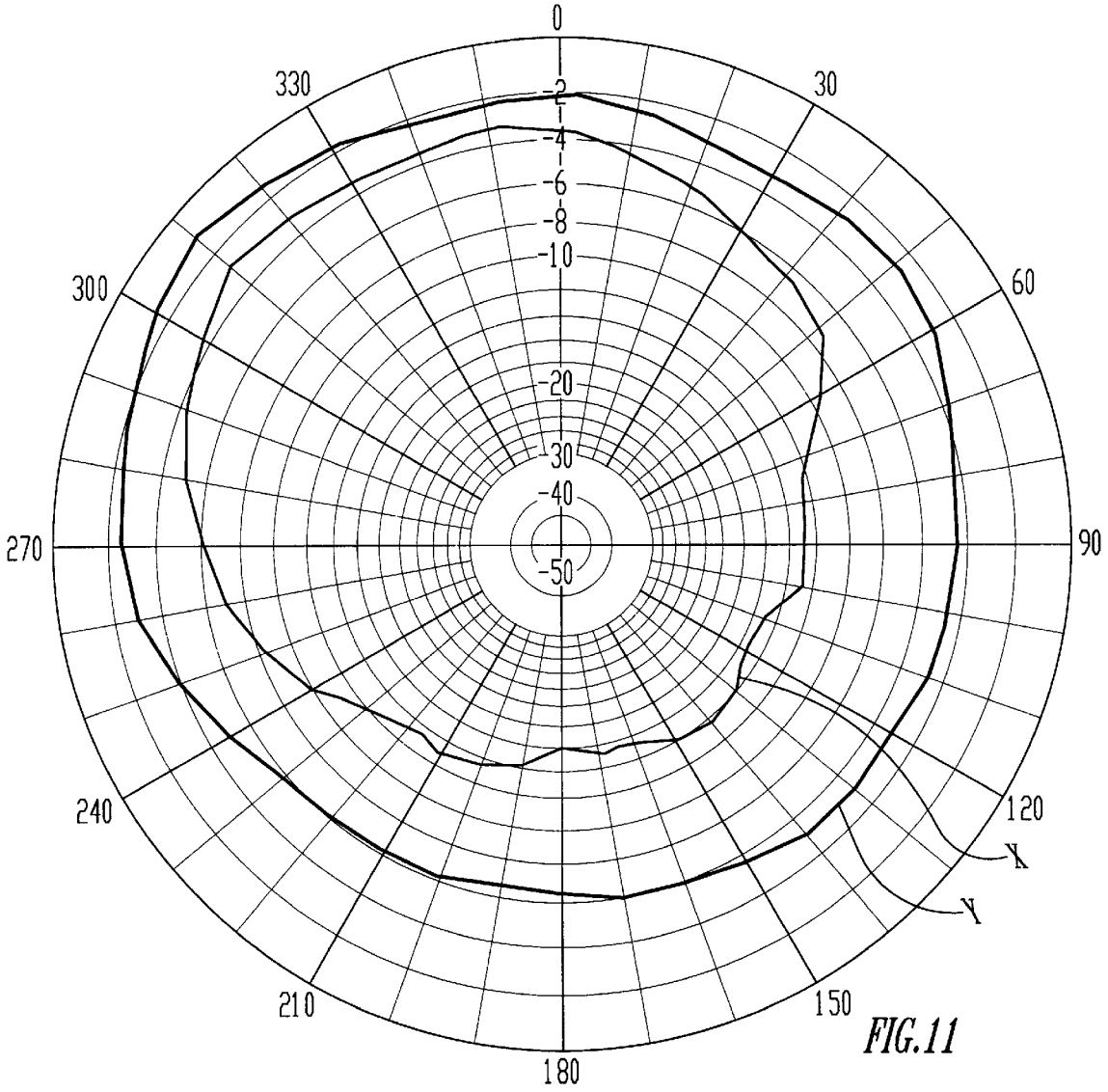
Figure 12:
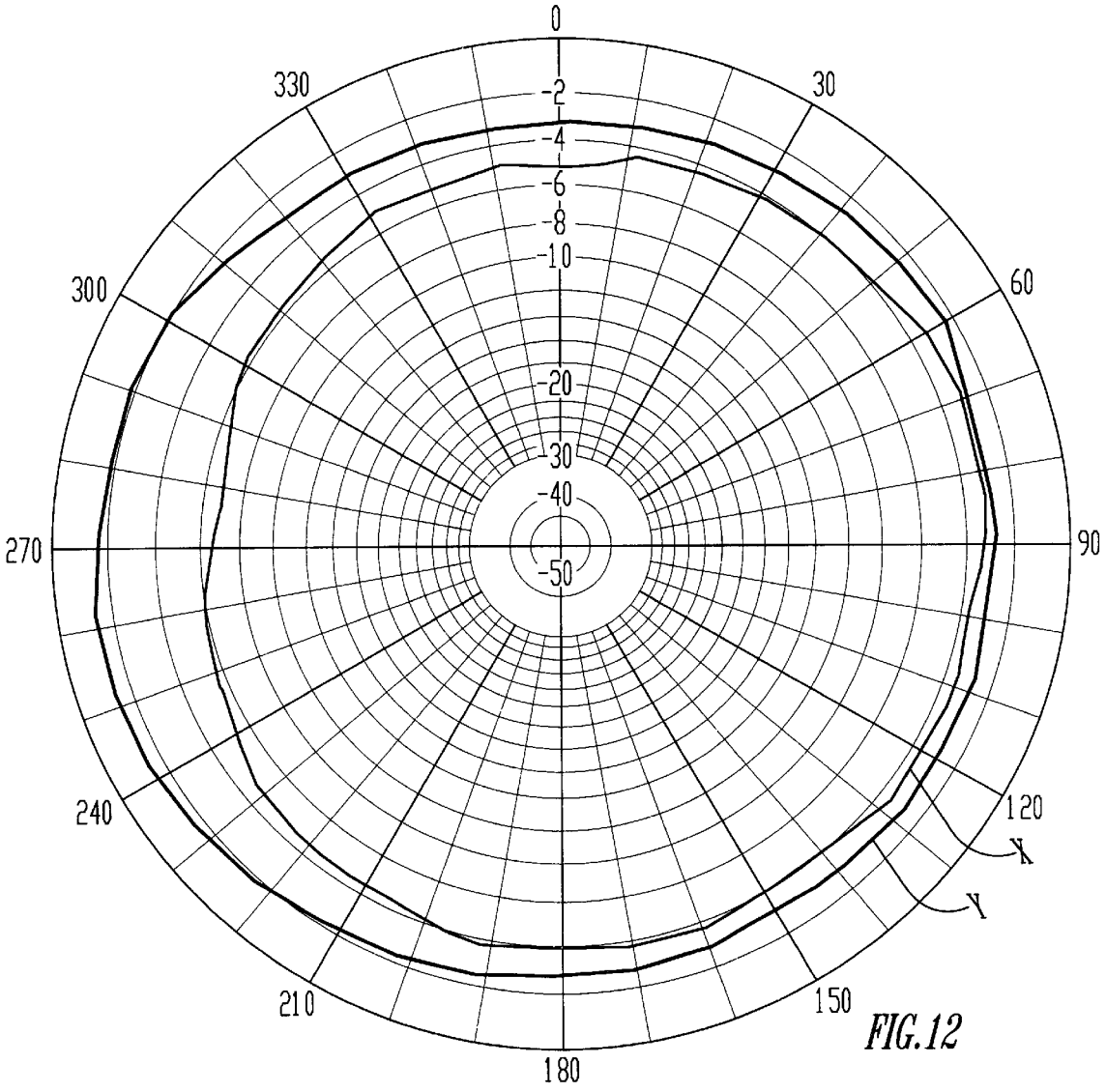

FIG. 5 shows an exploded view of the contents of module 48. FIGS. 1–4 show a conventional helical stub antenna 41 can be used in association with each module for RF transmission and reception. FIGS. 6 and 7, however, illustrate an antenna that can be utilized internally of the module as a replacement to the stub antenna. FIGS. 8–12 are antenna radiation pattern results illustrating the general equivalent performance of the antenna of FIGS. 6 and 7 with a conventional helical stub antenna.

Referring now to FIGS. 1 through 5, the basic environment for the invention will be discussed. In addition to this description, reference should be taken to commonly owned and co-pending U.S. patent applications Ser. No. 07/426,135, to George E. Hanson, filed Oct. 24, 1989, and to U.S. Ser. No. 07/735,610, to George E. Hanson, filed Jul. 23, 1991. FIGS. 1 through 5 correspond directly to FIGS. 1–4 and 6, respectively, of Ser. No. 07/735,610, and identical reference numerals used in those drawings are utilized in the present drawings for simplicity. The above two co-pending, co-owned applications are incorporated by reference herein.

FIG. 1 basically shows a radio frequency (RF) transceiver 10 having a housing 14, a stub antenna 41, and a display 19, as well as such features as a keyboard, connectors, and other components as are fully explained in that application. These type of devices are relatively small in size (palm-size) and are easily transportable. They operate on rechargeable batteries and therefore are completely portable. The device can send and receive RF communications utilizing such battery power.

In this particular embodiment, housing 14 is made of relatively rigid plastic material. Additionally, as shown in both FIGS. 2 and 3, portions or modules for the housing such as shown at number 48 in FIG. 2, and number 51 in FIG. 3, can be removed. The purpose for this ability is to either gain access to the interior of the device 10, to allow interchangeable components to be used with the device 10, or otherwise enhance the flexibility of such devices.

Figure 2:
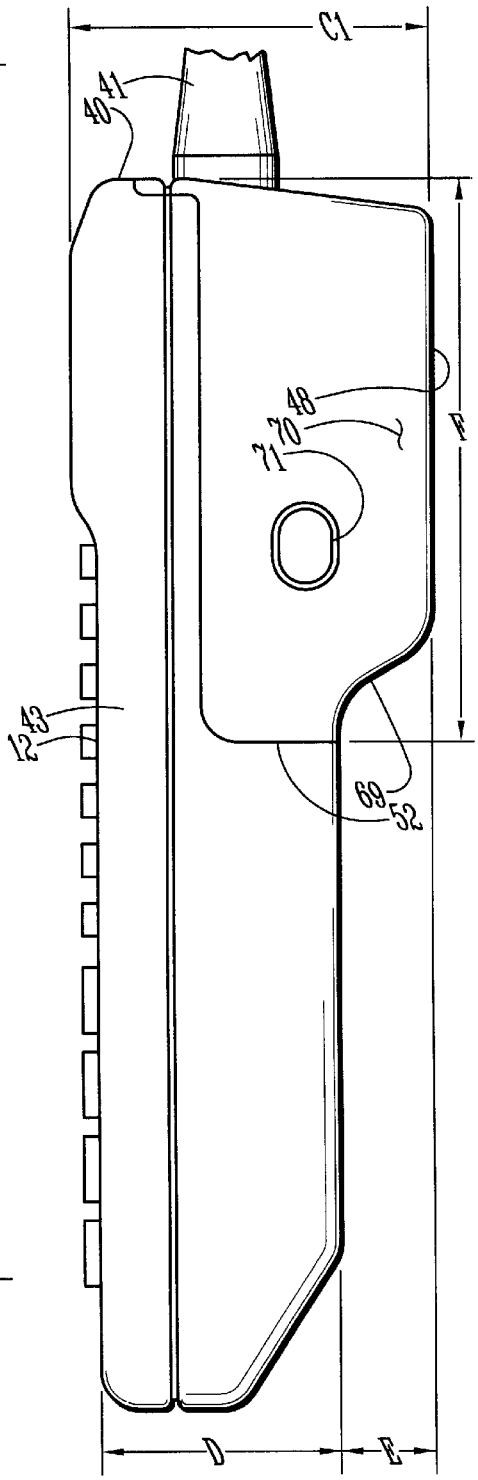
FIG. 2 is a side view of FIG. 1 showing a modular removable component including a helical stub mount antenna.
Figure 3:
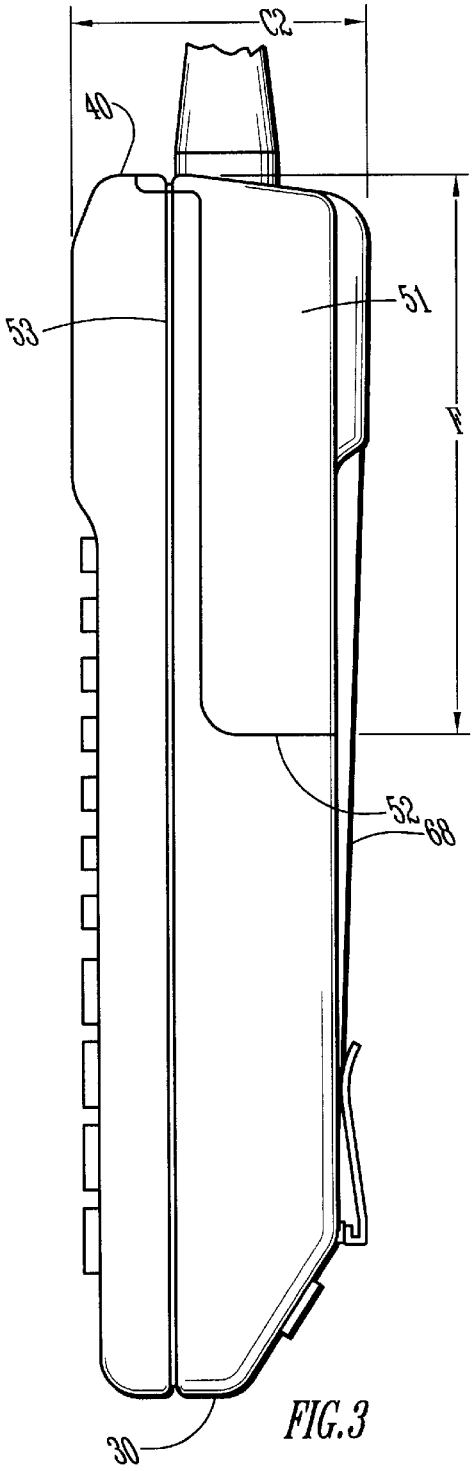
FIG. 3 is a side view of FIG. 1 showing an alternative modular add-on component with a helical stub antenna.

It is to be noted that in both FIGS. 2 and 3, components or modules 48 or 51 can be removed (such as is illustrated in FIG. 4), and both have the stub antenna 41 connected thereto.

By referring more specifically to FIG. 5, module 48 (such as is shown in FIG. 2), is shown in isolation along with the components that would be assembled into what will be called module housing or frame 48. It is noted that stub antenna 41 is shown as removed but would be secured at the antenna mount 78 on frame 48.

It can therefore be seen that devices of this type are manufactured to receive the many components shown in FIG. 5, which are densely packed into frame 48.

Elimination of the stub antenna presents significant problems. As previously described, the very nature of electrical components generally results in framework or mounting surfaces which are of complex shape and form to provide mounting structures for the components that must be packed into the device. Additionally, those components must be closely packed inside the frames or housings of these devices. This close packing does not lend itself to easy placement of an antenna within such a framework or housing.

Additionally, as previously described, the antenna performance and characteristics for such devices are not merely solved by utilizing plate antennas such as are shown and described in U.S. Pat. No. 4,958,382 by inventor Imanishi (see particularly FIGS. 3 and 4), or interior antennas such as shown in incorporated by reference Ser. No. 07/426,135 at FIGS. 2 and 4, in particular.

Still further, it is many times not desirable or possible to utilize the exterior surface type antenna shown at reference numeral 70 in U.S. Pat. No. 3,826,900 to inventor Moellering (see particularly FIG. 2).

Elimination of stub antenna 41, from the present type of device 10, therefore requires consideration of at least the following factors:

1. shape of device 10 and frame 48 or 51,
2. room externally and internally in the assembled device 10,
3. the required gain for the antenna,
4. VSWR performance,
5. frequency of operation,
6. other functional needs of device 10 beyond RF transmission and reception (such as the need to move the device close to a bar code if a bar code reader, for example, is incorporated into the device).

In the preferred embodiment of the present invention, frame 48 could take on a configuration generally as shown at FIG. 7. Frame 48 would basically attach to the top and back of device 10 and would include components similar to those shown in exploded fashion in FIG. 5 (but not shown in FIG. 7). Additionally, a rectangularly shaped box 7-10 is integrally formed to the rear top of frame 48 as shown in FIG. 7. The interior of box 7-10 is configured to receive a device such as a bar code scanner element (not shown). Such a scanner would have to be moveable into close proximity with bar codes to be read and therefore the top of device 10 and the area around frame 48 must be clear of any structure which would inhibit such placement; this is one reason for the elimination of stub antenna 41 in the preferred embodiment.

It is also noted that a wall 7-12 is integrally formed on the top of frame 48 and in front of box 7-10.

In the particular embodiment shown in FIG. 7, therefore, placement of an antenna 7-14 is a non-trivial matter. The design characteristics set forth above reveal substantial hurdles to successfully incorporating an antenna in such a configuration.

By referring to FIGS. 6 and 7 together, the preferred embodiment can be explained in more detail. FIG. 6 illustrates antenna element 7-14 prior to conforming insertion to frame 48. In the preferred embodiment antenna element 7-14 is made of one thin layer of copper (shown facing up in FIG. 7) bonded to a thin layer of insulating material (not shown). As can be seen in FIG. 6, a central portion 7-16 of the antenna is bounded by a long arm 7-18 and a shorter arm 7-20 which extend from opposite ends of the middle portion 7-16. Additionally, ears 7-22 (or "B") and 7-24 (or "B") extend from middle portion 7-16.

FIG. 6 also shows that the basic geometry of antenna 7-14 can be manufactured out of a planar sheet of copper and a planar layer of insulating material. Both such materials must be flexible for conforming placement onto device 10 such as shown in FIG. 7.

It is furthermore noted that in the preferred embodiment, the very end of short arm 7-20 is electrically connected to a nickel/gold pad 7-26 which can be used to connect antenna 7-14 to connection circuitry for electrical communication to the electrical components of transceiver device 10.

As can be seen in FIG. 7, the structure and geometry of frame 48 are preestablished. They must therefore be taken into consideration by the designer.

The performance requirements of an antenna have previously been established for transceiver device 10. The stub antenna 41 is one form an adequate antenna could take. Therefore, the designer has information regarding antenna performance characteristics upon which to judge the acceptability of performance and the design of antenna 7-14. In the preferred embodiment, the designer understands that both length of antenna 7-14 as well as the makeup and proximity of the parts of the antenna 7-14 affect such performance.

FIG. 6 specifically identifies various portions of antenna 7-14 by the reference letters A through F. By direct comparison to FIG. 7, it can be seen where these components end up on the structure of frame 48. As is obvious, the antenna 7-14 must be bent, shaped, and otherwise conformed to the various surfaces of frame 48. Portions B are utilized in part as basically anchor sections on opposite sides of box 7-10. The middle portion 7-16 would run along the back side of box 7-10 in FIG. 7. Short arm 7-20 wraps around the front of box 7-10 and pad 7-26 lies horizontally along the top surface of frame 48 for connection to other circuitry.

In comparison, long arm 7-18 portion C would wrap around the opposite front side of box 7-10 and travel along said front of box 7-10 until it is basically adjacent but not touching short arm 7-20 portion A. It then (at portion D) travels forwardly over wall 7-12 and then back along the front of wall 7-12 (portion E), until wrapping around and inside of wall 7-12 ending in section F (the "J-shaped" portion).

The various letter portions of antenna 7-14 never abut one another but closely conform to each of the surfaces of frame 48 upon which it is placed. Essentially antenna 7-14 is a very thin, surface-covering decal which fits well within the confines of frame 48. It can be attached by glue or adhesive such as is within the skill of those skilled in the art.

FIGS. 8 through 12 are antenna radiation pattern plots of the performance of antenna 7-14 in comparison to stub antenna 41. It can be seen that the various angles of measurement are between horizontal and vertical, and the performance of antenna 7-14 fairly closely approximates that of stub antenna 41. In each drawing the plot for the conformed antenna is labelled "X" and the plot for the stub antenna as "Y".

It is to be understood that the above described embodiment of antenna 7-14 is specifically configured for the shape of frame 48 and the operating characteristics of device 10. It is to be clearly understood that similar design criteria can be utilized for other physical shapes for devices to which an antenna according to the invention is to be applied.

The present invention can be utilized with a wide variety of radio frequency transceiving devices. Some examples are personal computers, printers, computers, televisions, or any other device that transmits or receives communications over RF frequencies.

Although linear and similar simple geometry antenna characteristics are basically defined by an antenna's length, attempts at creating conformal antennas by simply placing a similar length of foil along the surface of a transceiver housing has met with disappointing results. A conformal antenna placed within the housing of an electronics apparatus must be shielded from the electronics contained therein. For this reason, a metal surface, while separate from the foil antenna, is interposed between the antenna and the enclosed electronics. Placing the antenna in close proximity to the shield, as is well known in the art, will produce a profound effect on the antenna's impedance. Additionally, the complex shape required of a conformal antenna will affect its impedance. Because of these effects on the antennas impedance created through the aforesaid mechanisms, the antenna's performance will be adversely effected unless the impedance effects are compensated for.

The present invention provides a new technique to compensate for the complex interactions between an electronics housing, the sometimes convoluted geometries of a conformal antenna, and their effects on the antenna's performance.

FIGS. 1–12 therefore show that a replacement for a conventional helical stub antenna can be achieved by internally mounting an antenna of the type of FIGS. 6 and 7 to a module that can be releasably connected to a hand-held terminal 10. The invention therefore eliminates the problems associated with the stub antenna while maintaining equivalent or even improved antenna performance. The antenna also is directly built into each module requiring an antenna. Therefore, it eliminates the need or use of an antenna if a module does not require an antenna. Antennas of the present invention need not, of course, be modular, the present invention includes integral antennas as well.

c. FIGS. 13 Through 15A–E

Another aspect of the invention is shown at FIGS. 13 through 15A–E. It is important that the performance of an antenna such as that shown in FIGS. 6 and 7 not be substantially different than that of a helical stub antenna. One factor which can impact on the performance of an internally mounted antenna is the fact that physical structure is generally required to cover the antenna to prevent it from exposure and damage. Material must be selected to accomplish the function of protection, yet must be as electromagnetically permeable as possible. Still further, its physical shape and size preferably should be in conformance with the shape of the hand-held terminal and not substantially extend or increase the outer dimensions of the terminal.

Figure 13:
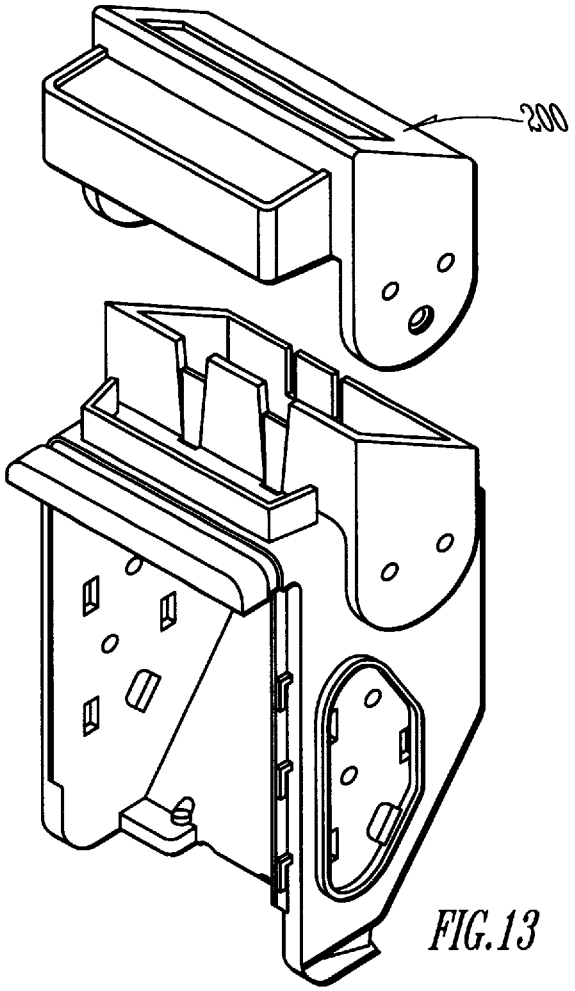
FIG. 13 is similar to FIG. 7 but additionally showing a removable cover in exploded fashion from the top of modular FIG. 7.

An example of this concept is shown in FIG. 13, in relation to the antenna and module shown at FIG. 7. A cover piece 200 as shown in FIG. 13 is mountable directly over the top portion of module 48. It would completely cover and encapsulate antenna 7-14 and any other components (not shown) and provide protection from the elements and environment, as well as physical contact.

In the preferred embodiment cover 200 closely conforms to the shape of the top of module 48. It is made of a dielectric material which is somewhat flexible. Therefore, it can protectively cover the antenna without compromising any shielding that may be required between the antenna and internal circuitry of the terminal, which might occur if, for example, the antenna were placed internally of the structure of the module 48.

Figure 14:
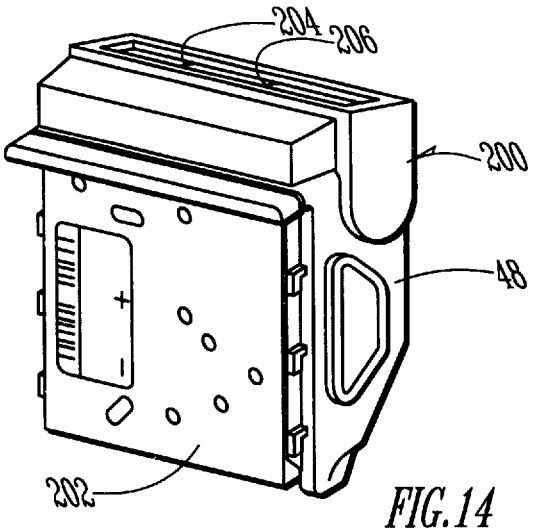
FIG. 14 is an assembled view of the module according to FIG. 13, including the assembled cover piece and assembled back piece.
Figure 15A:
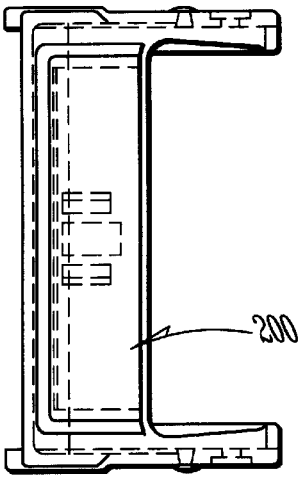
FIGS. 15A–15F show isolated views, some of which are partially sectional views, of the cover piece of FIGS. 13 and 14.
Figure 15B:
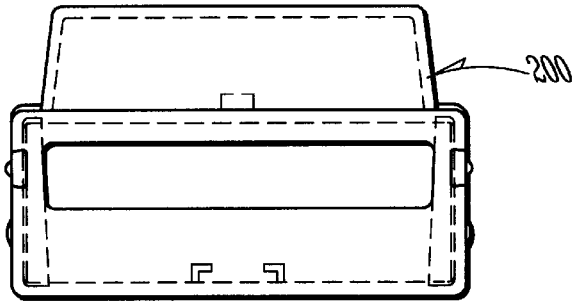
Figure 15C:
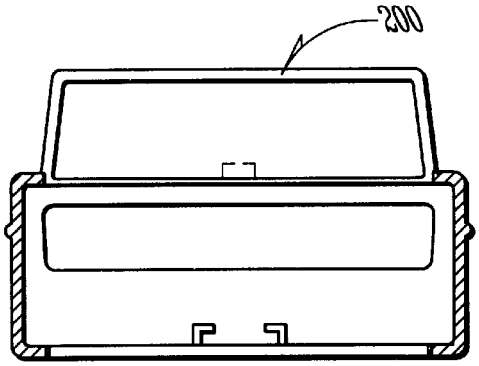
Figure 15D:
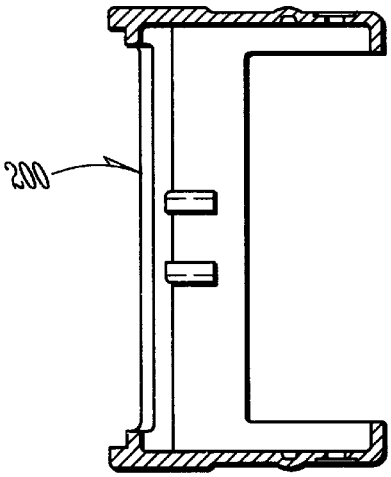
Figure 15E:
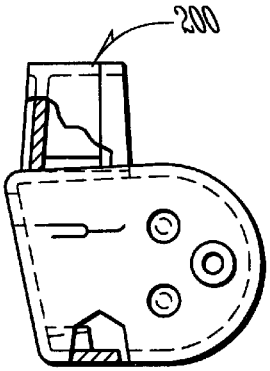
Figure 15F:
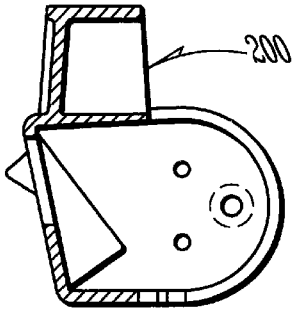
Figure 16:
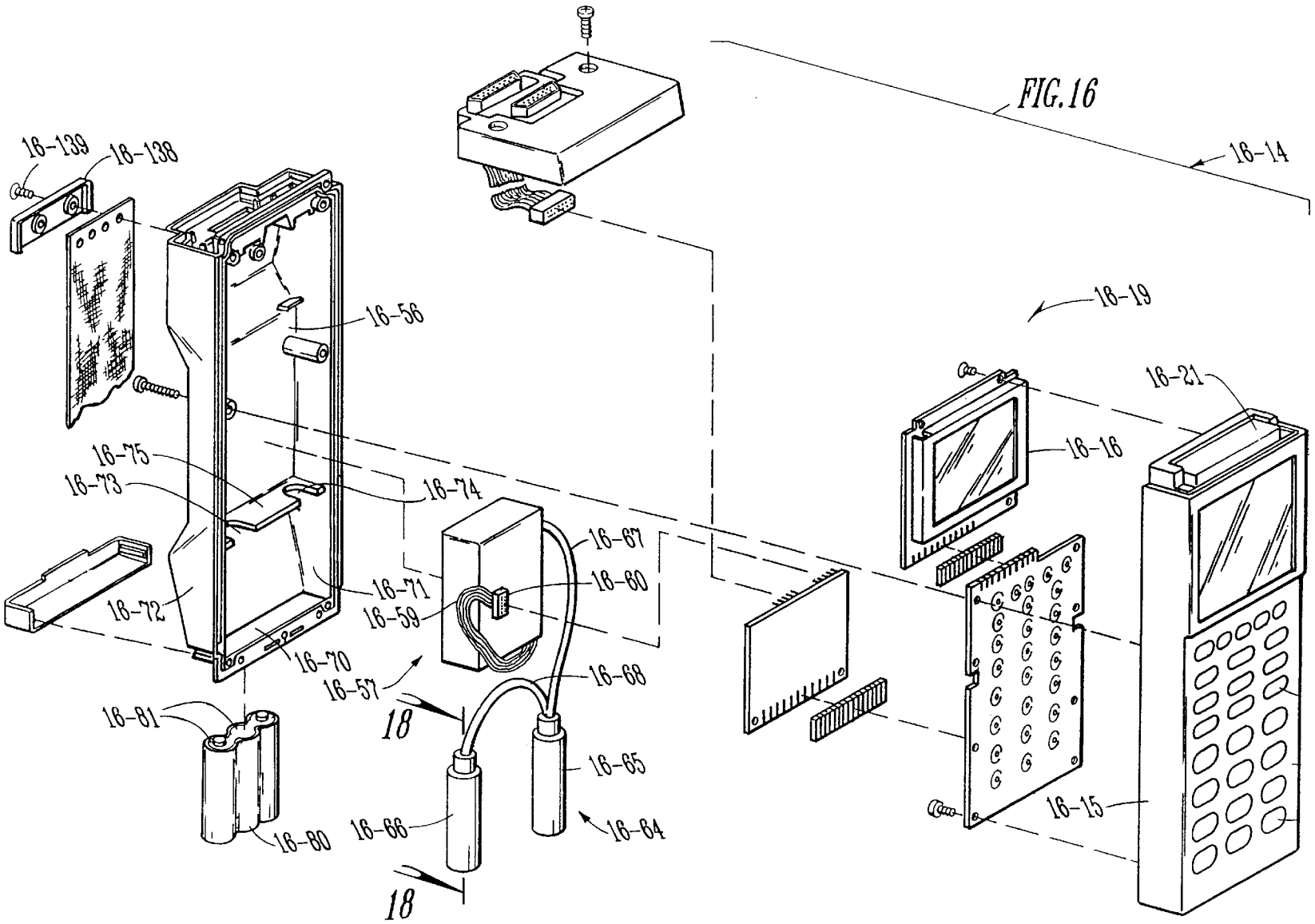
FIG. 16 is an exploded perspective view of a hand-held terminal illustrating another embodiment of an antenna according to the present invention.

FIG. 14 shows cover 200 as positioned over the top of module 48 and the antenna 7-14 (not shown). Additionally, a cover plate 202 is shown as attached over the interior chamber module 48 to complete the housing for module 48.

In this embodiment, module 48 comprises an RM20 CCD integrated scanning module for the RT1000/1100 UHF radio terminal available from Norand Corp., Cedar Rapids, Iowa.

As can be seen in FIGS. 13 and 14, cover 200 also accommodates an opening 204 for access to a scanner lens 206 according to the functioning of this module 48. The antenna, and its covering components, therefore do not interfere with the functions of this module, even though those functions are directly adjacent the position of the antenna.

FIGS. 15A–15F are specific views showing the exact structure of cover 200.

In this preferred embodiment, cover 200 is made of santoprene 201-73 available from Advanced Elastomer Systems. The outer surfaces of cover 200 can be somewhat textured if desired.

It is noted that the mounting of the antenna on module 48 is at the top of module 48. Therefore, electromagnetic radiation has primarily only to pass through cover 200 to reach the antenna 7-14. In this embodiment, the antenna 7-14 is as previously described with respect to FIGS. 6 and 7 and closely conforms to the surfaces of module 48 and is wrapped around the upper surfaces of module 48.

d. FIGS. 16 to 22

A different embodiment according to the present invention is shown in FIGS. 16 to 22. The primary difference from the embodiment discussed in previous drawings is that the antenna element of this embodiment is positioned internally of a hand-held terminal, but down in a battery compartment near the bottom of the terminal. A detailed description of the antenna and its placement in the terminal is as follows.

Terminal 16-14 utilizes a radio transceiver 16-57 for RF communication. The modulating-demodulating functions of the transceiver circuit 16-57 prepare the outgoing data messages for transmission via the antenna 16-64 (see FIG. 16).

Figure 17:
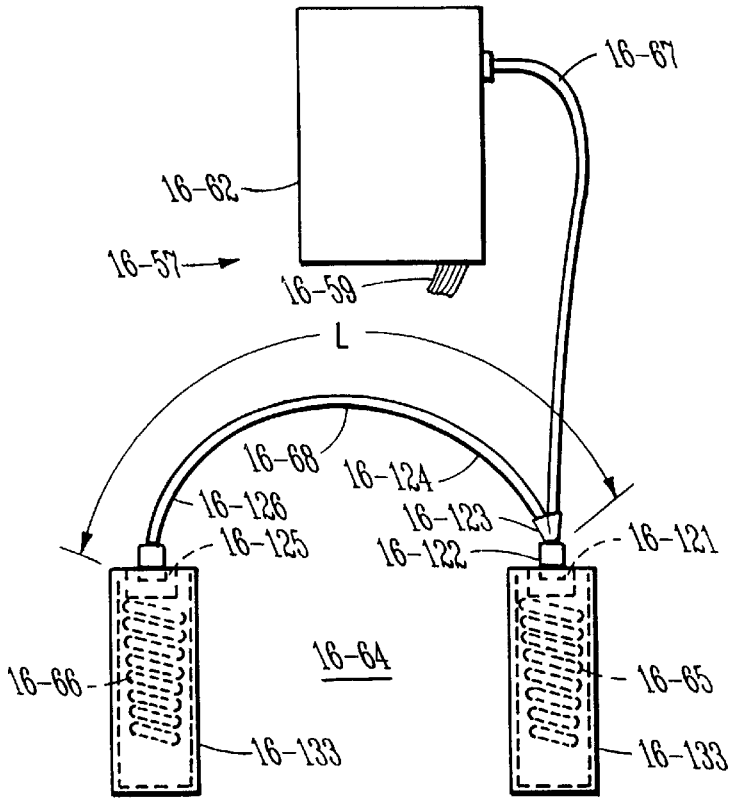
FIG. 17 is an isolated plan view of the antenna and transceiver component of FIG. 16.
Figure 19:
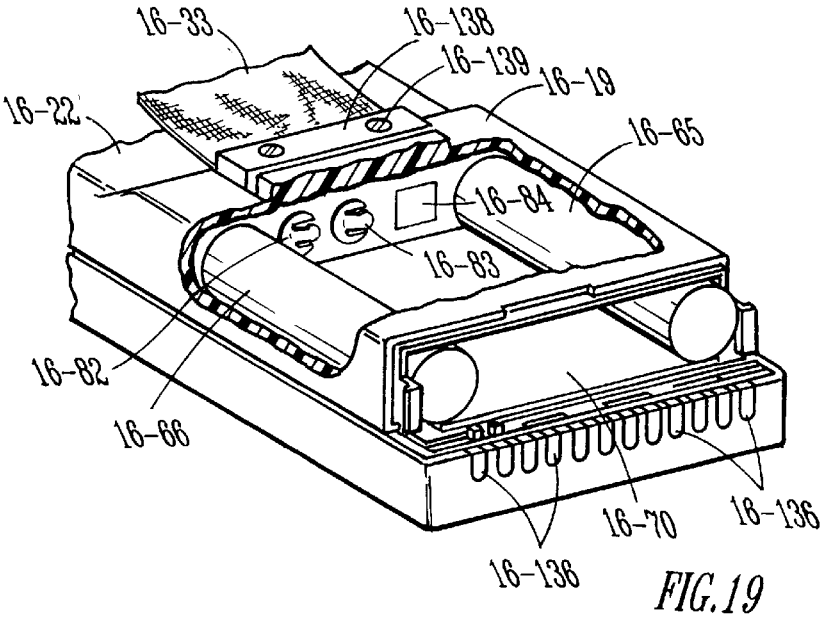
FIG. 19 is an isolated partial cutaway view of the antenna element of FIG. 17 as assembled into the hand-held terminal of FIG. 16.

The antenna 16-64 is depicted in greater detail in FIG. 17. In the preferred embodiment the lead-out connection from the transceiver module 16-57 to the antenna 16-64, namely the coaxial cable segment 16-67, is of a convenient length for routing along the inside of the housing 16-19 toward the battery compartment 16-70 (see FIG. 16, for example). The cable segment exits at a convenient point from the metal enclosure 16-62 of the transceiver module 16-57, preferably somewhat removed from the control, data and power cable 16-59. The radiating elements 16-65 and 16-66 are then mounted along the sides and within the battery compartment 16-70, as shown in FIG. 19. Still in reference to FIG. 17, the cable segment 16-67 terminates at a coupling 16-121 which is a base for the first radiating element 16-65. At a connection 16-122 to the coupling 16-121, a splice 16-123 couples a first end 16-124 of the coaxial linking cable 16-68 to the coaxial cable segment 16-67. The length "L" of the linking cable 16-68 between the splice 16-123 and a coupling base 16-125 adjacent the second end 16-126 of the cable 16-68 is currently preferred to be equal to one-fourth of the wavelength of the carrier wave of the RF signals transmitted through the radiating elements 16-65 and 16-66. It is believed beneficial in allowing the two radiating elements 16-65 and 16-66 to be coupled in parallel without increase in the impedance of the antenna, in that one of the radiating elements will be phasing through peak radiating power when the second radiating element is at a node. A quarter wavelength difference at the contemplated radio frequency, contributed by the length "L" of the coaxial linking cable 16-67 is believed to bring about the desired result. It is, of course, possible to change the length "L" to a different length, such as to a three-fourths wave length delay for a similar result. In the alternative, it may be deemed desirable to choose the coaxial cables to be of length from a splitting link, such that the radio transmission wave is simultaneously at a peak or at a node at both of the elements 16-65 and 16-66.

Figure 18:
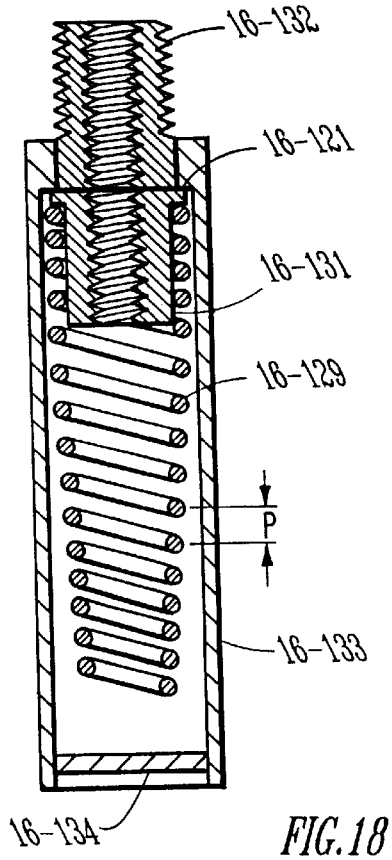
FIG. 18 is a sectional view taken along line 18—18 of FIG. 16.

In the preferred embodiment, the radiating elements 16-65 and 16-66 are identical coiled wire springs 16-129, the structure of a representative one of which is shown in greater detail in FIG. 18. A preferred material for the springs 16-129 is copper-plated music wire of 0.05 inch diameter. The uncoiled length of that portion of the music wire of the spring 129 that extends free beyond the coupling base 16-121 is chosen to be equal to one-half of the wavelength of the carrier wave intended to be transmitted by the spring 16-129 as radiating element 16-65 or 16-66. Since it is desired to house the radiating element in the space of a size AA battery, a space constraint exists that the coil of the spring 16-129 should not exceed 0.4 inches in diameter. The coils for the springs 16-129 for the radiating elements 16-65 and 16-66 preferably have a slight taper with an average diameter of approximately 0.38 inches. With such a diameter, eleven turns of wire are required to coil a length of 12.8 inches of wire. Such length is equal to half a wavelength at a nominal transmission frequency of 460 MHz, the frequency range at which the transceiver circuit 16-58 would be operating. The total length of the wire for the spring 16-129 is approximately 17 inches, allowing for about three turns of the wire to be coiled onto and fastened to a shoulder 16-131 of the coupling 16-121. The wire is preferably soldered to the shoulder 16-131 to become permanently attached thereto. An outer end 16-132 of the coupling 16-121 may be threaded as is shown in FIG. 18, and the connection 16-122 may then be a threaded coaxial connector, or the end 16-132 may be a smooth-walled and of adapted to receive ends of the coaxial cable segment 16-67 and the linking cable 16-68 in a crimped or soldered connection for a permanent attachment of the coaxial link and cable segment to the radiating elements 16-65 and 16-66. The coupling 16-125 is similar to the coupling 16-121 except for the absence of the splice 16-123 as shown in FIG. 17.

Preferably, both radiating elements 65 and 66 are encased in a cylindrical plastic housing 16-133 which is molded about or attached by any other convenient method to the respective couplings 16-121 and 16-125. The plastic material chosen for the housing 16-133 may be the same as that of the front and rear shells 16-21 and 16-22, or of any other suitable material which is readily penetrable by RF energy. The outer dimensions of the housing 16-133 are preferably equal to those of a conventional size AA battery housing. The housing 16-133 is preferably closed at the end opposite the coupling 16-121 by a base cap 16-134 of circular configuration. The base cap lends rigidity to the cylindrical shape of the housing 16-133. However, as an alternative embodiment, the base cap may be omitted, particularly when the cylindrical housing is of such rigidity so as not to risk damage to the wound shape of the radiating element. Each of the turns of the spring 16-129 is spaced from its adjacent turn at a pitch distance "P" which maximizes the available space in the housing 16-133 such that the pitch distance is substantially equal between all adjacent turns of the spring 16-129. Contained by the overall dimensions of the housing 16-133, the radiating elements 16-65 and 16-66 fit into the outermost battery positions of the battery compartment 16-70 of the housing 19 as shown in FIG. 19.

FIG. 19 showing the lower portion of the housing 16-19 of the data terminal 16-14 also shows a plurality of contacts 16-136. The contacts 16-136 are molded into the rear shell 16-21 of the housing 16-19 and protrude to the outer surface of the housing 16-19. The contacts 16-136 include data input-output contacts which within the housing 16-19 are preferred to be electrically coupled to a communication buffer. Such an arrangement enables the contacts 16-136 to serve as an alternate data transfer connection for certain peripheral devices, such as, for example, the data transfer cradle 16-32 shown in FIG. 21. As such the contacts 16-136 as well as a corresponding connector provide data communications interfaces for the direct transfer of data or control messages by direct transfer through communications cables that may be coupled to the outside of the data terminal 16-14 via such interfaces. Again in reference to FIG. 19, the lower end of the hand strap 16-33 is shown attached to the rear shell 16-22 of the housing 16-19 by means of a clamping plate 16-138 and preferably two flat head mounting screws 16-139. The upper end of the hand strap 16-33 is similarly attached by means of the clamping plate 16-138 and the two mounting screws 16-139, as shown in the exploded view of FIG. 16.

Figure 20:
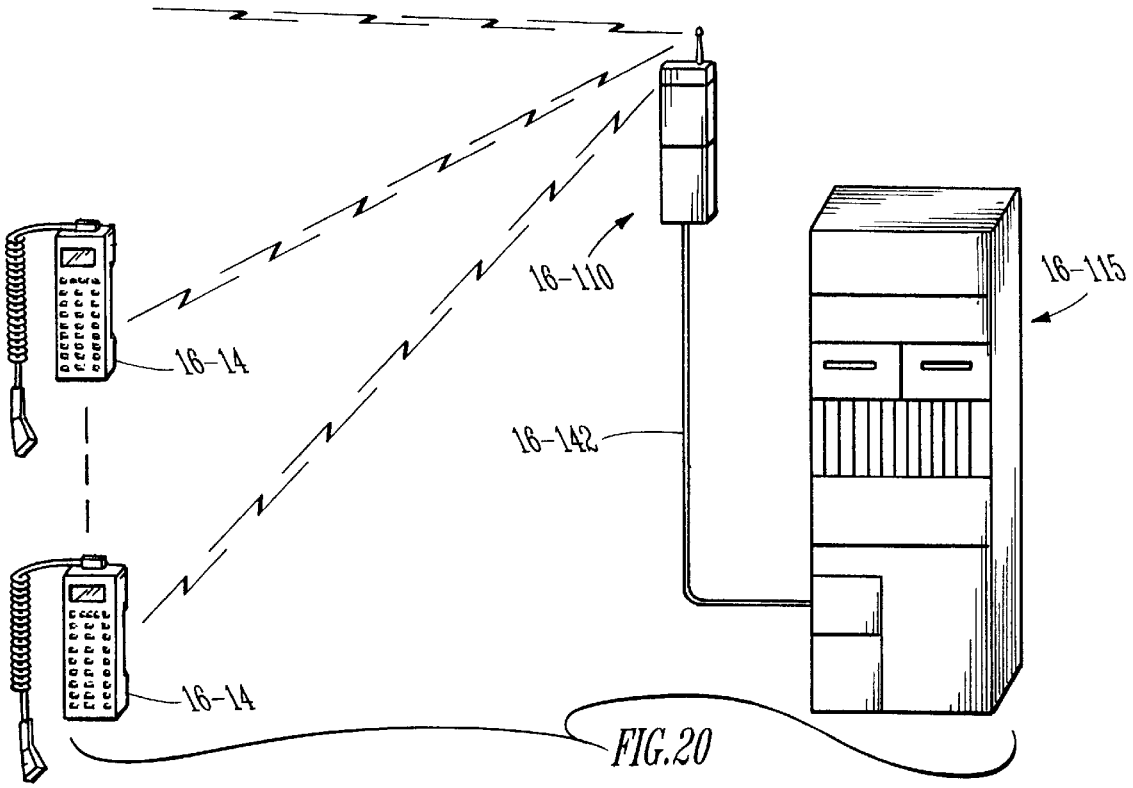
FIG. 20 is a perspective and somewhat diagrammatical view of several hand-held terminals and a base computer terminal.

One of the modes of operation of the data terminal 16-14 is best explained in reference to FIG. 20. Typically, a number of the data terminals 16-14 may be employed in conjunction with one of the transceiver base stations 16-110. The transceiver base stations are typical commercial stations capable of functioning in a multiplexing mode which allows a number of the data terminals to substantially simultaneously exchange data messages with the transceiver base station 16-110. The base station 16-110 may be wall-mounted or otherwise fixedly attached in a store area or warehouse. The transceiver base station 16-110 may be communicatively coupled from its designated fixed location through a cable 16-142 to the central computer 16-115. The computer 16-115 may be located in an office area remote from the base station 16-110. When used in typical retailing operations, the computer 16-115 may also be hard-wired to various cash registers. While the cash registers may transmit inventory depletion data on a real time basis to the computer, the data terminals 16-14 may be used to enter into the computer 16-115 existing inventory information or inventory restocking data. In a typical multiplexed type operation, each of the data terminals 16-14 would receive from the computer 16-115 via the base station 16-110 uniquely addressed data messages, such that typically only one of the data terminals 16-14 would decode and operate on a respectively addressed message from the computer 16-115. Also, data encoded by one of the data terminals 16-14 into data messages and transmitted to the base station 16-110 are uniquely identifiable by the base station 16-110 and by the computer, after being routed from the base station through the cable 16-142, as having been originated by that particular data terminal 16-14.

In an interactive mode, an operator of one of the terminals may input into the data terminal 16-14 via the bar code reader typical S.K.U. (Stock Keeping Unit) numbers. The data read into the terminal 16-14 will appear on the display 16-16 and will also be temporarily stored in RAM. The operator may then enter additional data via the keyboard 16-15, such as for example a quantity of the respective stock item which may have just been added to replenish depleted inventory. Upon a command to transmit the data, the data terminal assembles the entered data into a data message and transfers the message to the transceiver circuit 16-57 for transmission. The base station 16-110 routinely samples each data terminal 16-14 and receives the transmitted data message to forward it to the computer 16-115.

Instead of merely entering data into the computer by radio frequency transmissions, the data terminal 16-14 is capable of requesting information from the computer and have the information transmitted to appear on the display 16-16. The data terminal 16-14 consequently can be programmed to access certain or all data on the computer 16-115 to have available for its use the computing power of the computer 16-115. In stock-keeping operations depletion rates and restocking forecasts may be obtained. In retail operations price checks can be obtained on a real-time basis.

Figure 21:
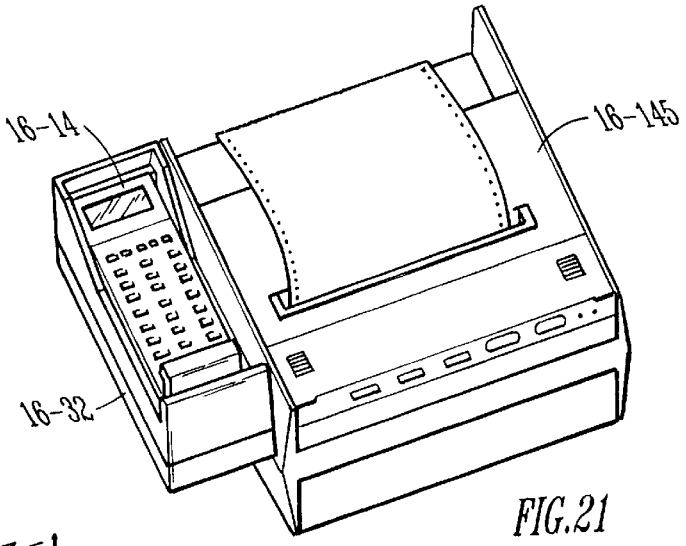
FIG. 21 is a perspective view of a hand-held terminal of FIG. 20 in a data communication cradle with a printer device.

In a further operational mode of the preferred embodiment illustrated by FIG. 21, the data terminal 16-14 may be inserted into the cradle 16-32 of a printer 16-145. The cradle 16-32 uses contacts (not shown) which become coupled to the contacts 16-136 of the data terminal 16-14. The cradle 16-32 connects the data terminal directly, meaning by typical hard-wired connections, to the printer 16-145 such that the printer can be operated via the keyboard 16-15. Typically printers such as the referred-to cradle and printer combination have been used with data terminals of the first type for printing order receipts or invoices in delivery route operations. In such operations, the driver enters the order or delivery confirmation and prints a hard copy for the customer's records. The printer 16-145 is typically capable of being operated from DC supply such as available on a delivery truck.

When the data terminal 16-14 is inserted into the cradle 16-32, it is possible to power the terminal 16-14 through power supplied to the printer, such as from the electrical system with which the printer 145 is powered. In such instance it may be possible to recharge the terminal 16-14 while the terminal is located in the cradle 16-32.

Figure 22:
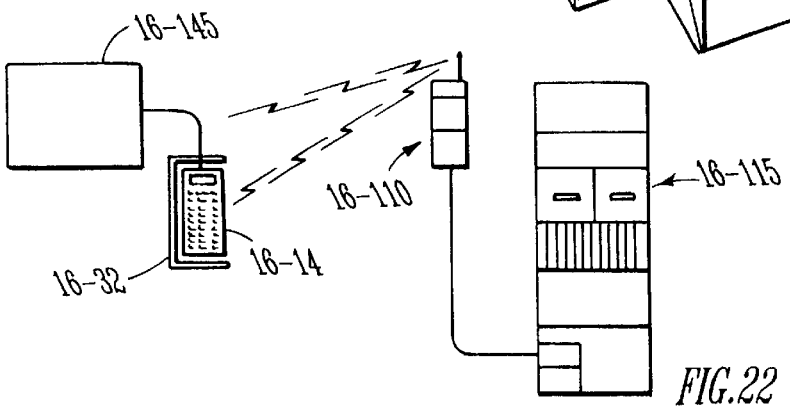

The data terminal 16-14, when used in combination with the cradle 16-32 and the printer 16-145, enables the printer to be used as a portable customer service station in a number of service operations where portability is required and customer receipts need to be printed. In such a combinational arrangement, the printer 16-145 and the data terminal 16-14 function as a single unit. Moreover, inasmuch as the transceiver 16-57 is a communications link to the central computer 16-115, an even more versatile combination is formed. The data terminal 16-14 inserted into the cradle 16-32, as shown in FIG. 21, connects the computer 16-115 to the printer 16-145 via the radio data link provided by the data terminal 16-14. The computer 16-115 has available in its storage peripheral various data files with product, inventory, pricing and customer information. The computer 16-115 may further be connected through conventional modems and telephone lines to obtain customer credit information. Thus, FIG. 21 shows a portable customer service station with the capability of receiving customer credit card data, charging a customer's account and printing a customer receipt on a completed transaction. FIG. 22 is a schematic representation of the combination of the data terminal 16-14 inserted into the cradle 16-32 of the printer 16-145 interactively communicating with the computer 16-115 by means of the base station 16-110.

In the schematic diagram of FIG. 22, the cradle 16-32 could also be coupled to a portable computer or may be a computer or data terminal which has accumulated a large volume of data over a period of time, but has no direct link to the central computer 16-115. By inserting the data terminal into the cradle 16-32, the computer becomes coupled directly to the data terminal 16-14 and thereby to the central computer 16-115 via the radio link established by the data terminal 16-14 and the base station 16-110. With the setup as shown in FIG. 22, it is possible to download accumulated data from the computer directly to the central computer 16-115. Also, if the computer is used for operations which require routinely updated information, it is possible to update information by temporarily coupling the data terminal 16-14 to the cradle 16-32 of the computer and to download such updated information by radio communication through the data terminal 16-14 from the central computer 16-115 to the computer.

Figure 23:
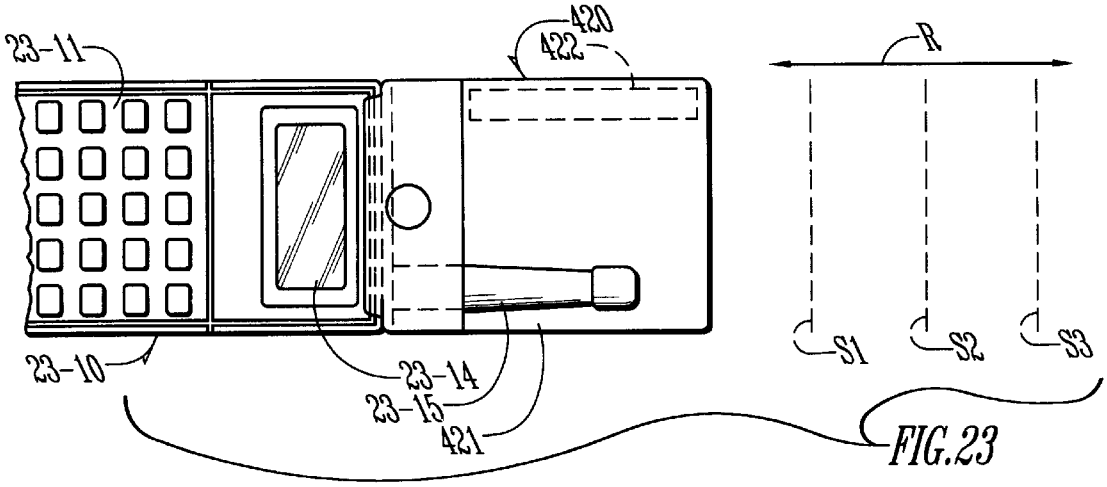
FIG. 23 is a partial top plan view of a still further embodiment of the hand-held terminal device including both a stub helical antenna and an internal antenna situated in the terminal.
Figure 24:
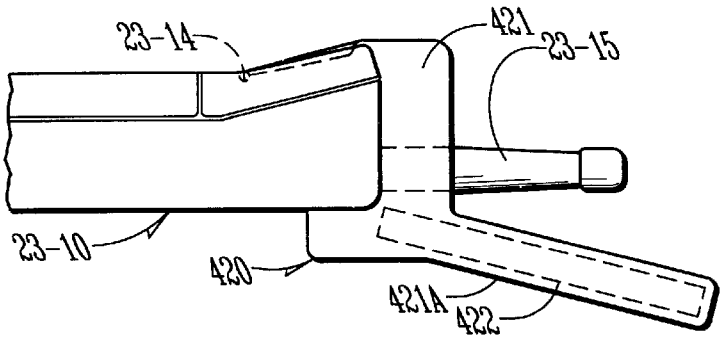
FIG. 24 is a side view of FIG. 23.
Figure 25:
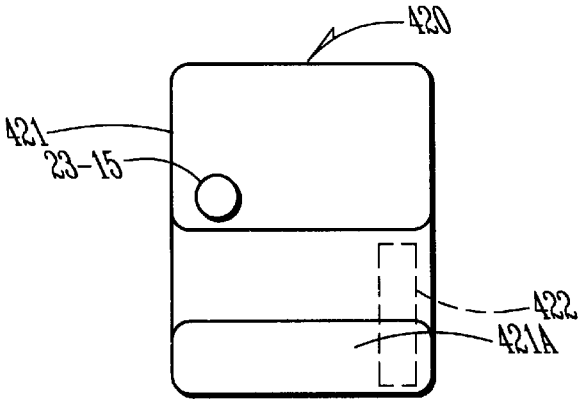
FIG. 25 is a top view of FIG. 23.

The embodiment shown in FIGS. 16–22 therefore shows that the stub antenna conventionally used can be replaced by antenna 16-64. Again, the antenna would be out of the way of physical interference with such things as cradle 16-32 and the like. As explained, the antenna is positioned so that its performance is not materially detrimentally effected by its internal location. A more detailed description of a terminal 16-14 of this type can be seen at co-pending Ser. No. 07/426,135, filed Oct. 24, 1989, and incorporated by reference herein.

e. FIGS. 23–25

A still further embodiment according to the present invention is shown at FIGS. 23–25. Here a replaceable removable module 420 is connected to a hand-held terminal 23-10. The RF data terminal 23-10 receives the RF/ID module 420 for operable use together. Module 420 has a suitable electromagnetic field permeable housing 421 which contains the RF/ID antenna 422 and other suitable components. It is noted that in this particular embodiment, terminal 23-10 has its own conventional stub antenna 23-15 which is connected to terminal 23-10 and does not obstruct removal and insertion of module 420.

It is noted that the angle of housing part 421A may be such that when antenna 422 is horizontal, terminal 23-10 will be at an angle to a horizontal plane providing for convenient viewing of the terminal display 23-14 by the user holding the assembled device in either hand.

Different modules may provide different operating frequencies and RF/ID antennas so as to be adapted to respective different scanning distances such as represented at S1, S2, S3 covering a desired scanning range R.

Antenna 422 is basically embedded and enclosed by the housing 421. It is positioned along one side of housing 421 to provide minimum physical occupation of the interior of housing 421.

For further details regarding the exact structure of this embodiment, references taken to co-pending U.S. Ser. No. 07/321,932 filed Mar. 9, 1989, which is incorporated by reference hereto.

f. FIGS. 26–29

Figure 26:
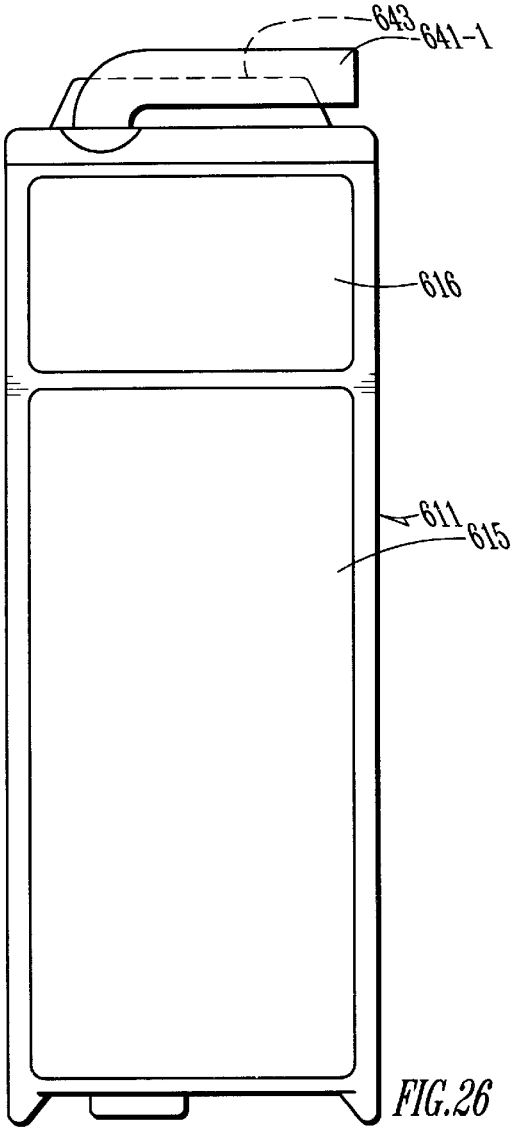
FIG. 26 is a still further embodiment of a hand-held terminal with an antenna according to the present invention.
Figure 27:
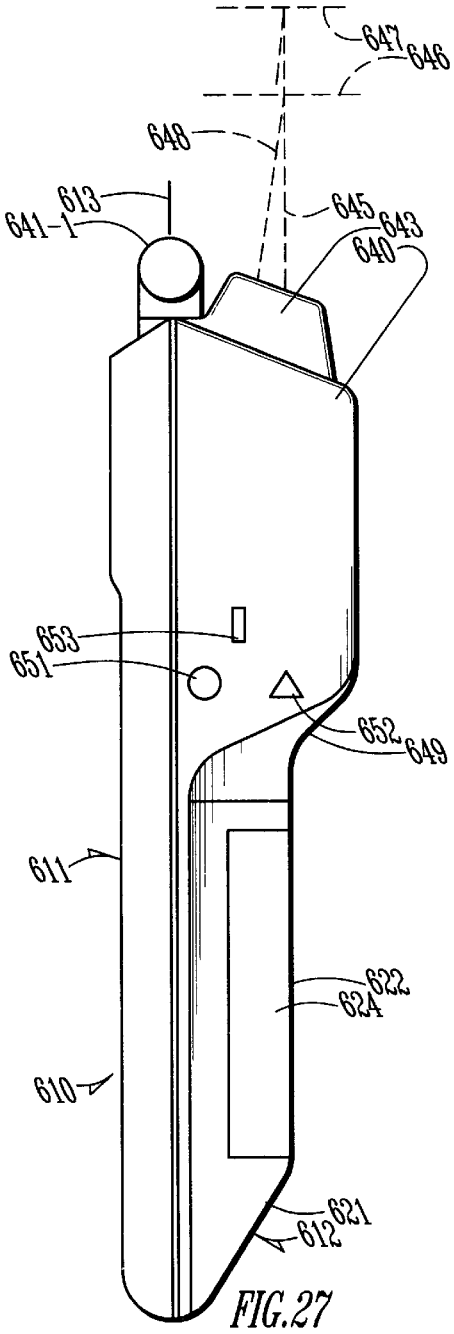
FIG. 27 is a side view of FIG. 26.

By referring to FIGS. 26–29, another embodiment according to the present invention can be seen. Further details are found at co-pending PCT/US90/03282, filed Jun. 7, 1990, which is incorporated by reference hereto. FIG. 26 shows a hand-held data terminal 611 with a display screen 616 and keyboard 615 indicated generally on its top surface. A peripheral module 640 may contain automatically operating transducer means comprised of an automatic wireless communications unit and an automatic full image reader unit. Module 640 may be provided with an antenna 641. An optical window is indicated at 642. The window 642 may be housed in a reader extension part 643.

Figure 28:
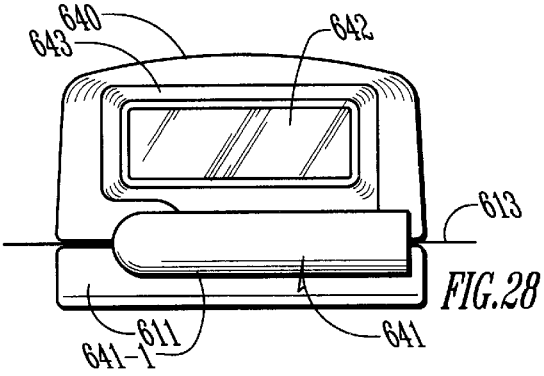
FIG. 28 is a top plan view of FIG. 26.
Figure 29:
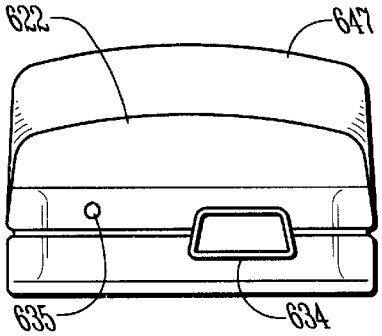
FIG. 29 is a bottom plan view of FIG. 26.

Antenna 641 may have a right angle bend portion so that the main antenna part may extend transversely as indicated at 641-1 of FIG. 28, and may be rotatable from a horizontal disposition such as shown in FIG. 26, to an upright position, for example.

Figure 30:
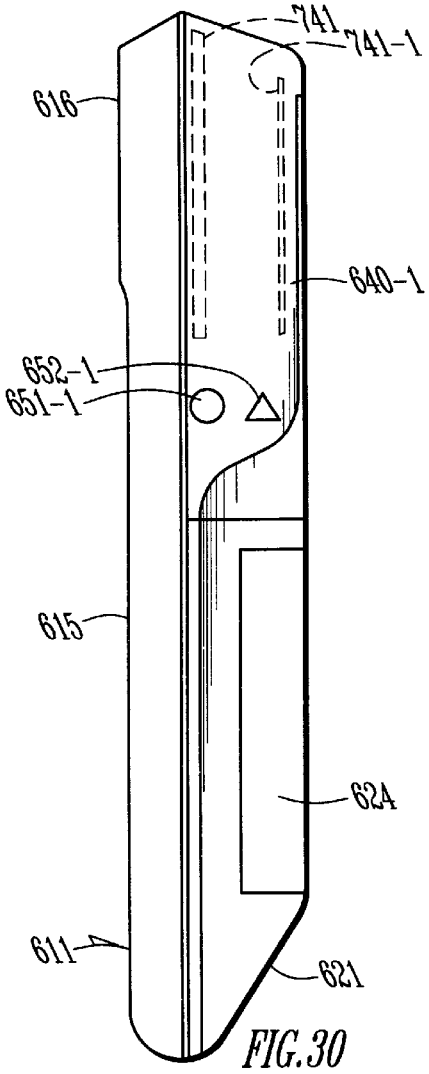
FIG. 30 is a still further embodiment of a hand-held terminal with an antenna according to the present invention.
Figure 31:
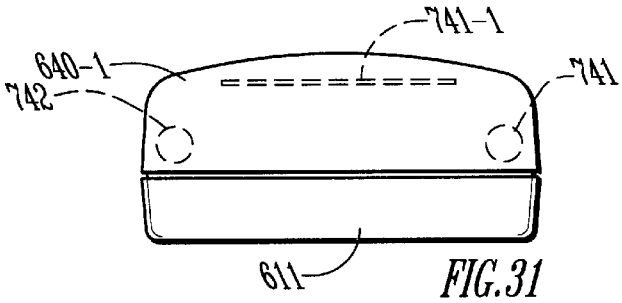
FIG. 31 is a top plan view of FIG. 30.

It can therefore be seen that an antenna can be encapsulated in the material which is not materially detrimental to the performance of the antenna, but that the antenna can be placed along the top of the hand-held terminal. In this particular example, it can be rotated to a position other than closely conforming to the top of the terminal if desired.

g. FIGS. 30–31

FIGS. 30 and 31 show an identical user interface terminal portion 611 with an identical hand-grip terminal portion 621 to that of FIGS. 26–29, but show module 640 replaced by module 640-1 which may contain only a wireless communication unit such as a radio transceiver. Module 640-1 may have manually actuated selectors such as 651-1, 652-1 symmetrically arranged on the respective sides thereof. In FIGS. 26–29, antenna 641-1 is shown as being of the right angle type capable of swiveling from a horizontal position such as shown in solid outlining in FIG. 26 to an orientation perpendicular to junction plane 613 (FIG. 27) for example. This type of antenna is, of course, also applicable to FIGS. 30 and 31.

Figure 33:
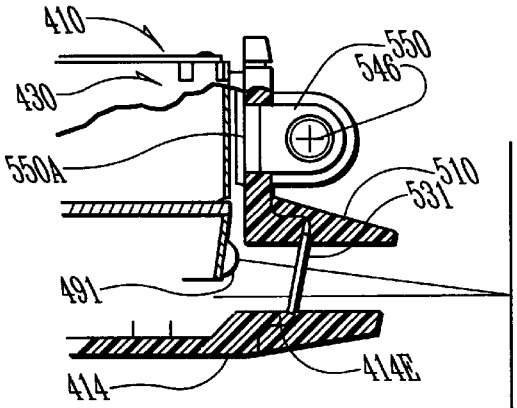
FIG. 33 is a sectional view of FIG. 32 taken along line 33—33 of FIG. 32.
Figure 32:
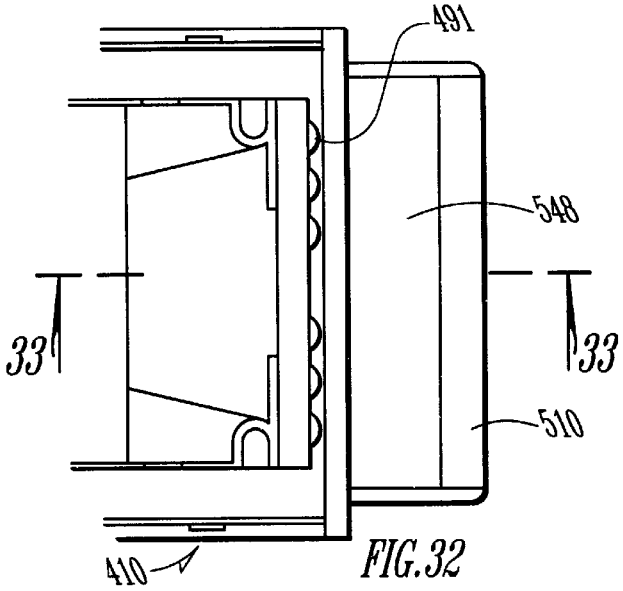
FIG. 32 is a top plan view, with a partial cutaway, of either the top of a hand-held terminal or a module that is connectable to the top of a hand-held terminal, and including an antenna means according to the present invention.
Figure 37:
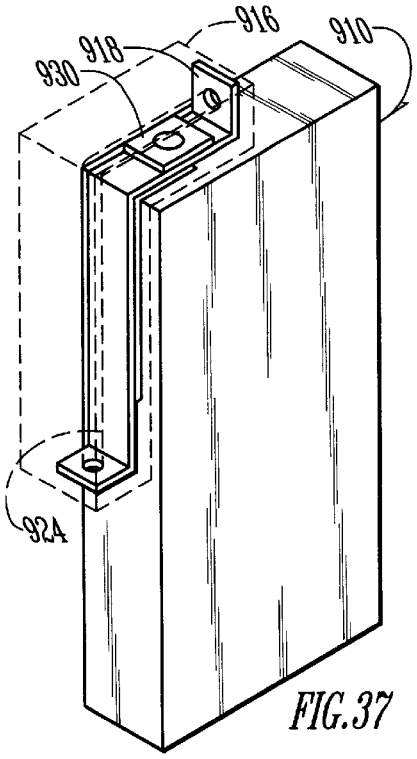
FIG. 37 is a perspective view of a hand-held terminal and illustrating in more detail the connection of the antenna element to the terminal.
Figure 36:
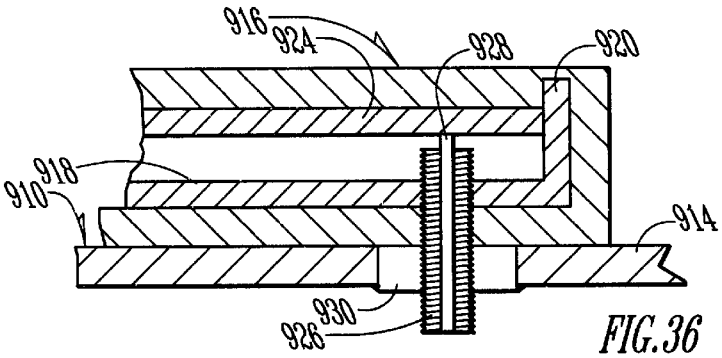
FIG. 36 is an enlarged detail of the antenna element of FIG. 35 as attached to the terminal case of FIG. 34.

As a further example of antenna location, a pair of antennas may be located as indicated at 741, 742, FIGS. 36 and 37, and these antennas may be of a fixed type covered by the dielectric of the module housing so as to be completed enclosed, or for example, embedded in the dielectric walls of the module so as to be partially exposed. It is also possible that various flat type antenna configurations could be located within the dielectric walls of the module 640-1, for example located as generally indicated at 741-1. Such antenna arrangements are applicable to each of the embodiments herein including the module 640 of FIGS. 26–29.

h. FIGS. 32–33

FIGS. 32 and 33 illustrate a further module (image reader/RF) for assembly with a base module and which may readily incorporate a laser reader system with no moving parts. As seen in FIG. 33, housing 414 is provided with an outwardly protruding seat, 414E, which receives a snap-on cowl piece 510 which serves to retain an optical window 531 covering an elongated generally rectangular opening at the front housing 414. As shown in FIGS. 17 and 18, module 410 has a transverse by extending antenna 546 housed within a dielectric cover 548 completely within the confines of the length of housing 414 with cowl 510, and within the width dimension of housing 414. The antenna may be a helically wound wire type, and may be carried by fitting 550 having an enlarged base 550A for coupling with the RF circuits 430.

This embodiment therefore utilizes a helical wire wound antenna, but encapsulates it or encloses it within the cowl 510 so that it eliminates the problem of damage or breakage if it would extend freely of housing 414 away from housing 414. Further information regarding this embodiment can be found at co-pending Ser. No. 07/735,610, filed Jul. 23, 1991, which is incorporated by reference herein.

i. FIGS. 34–38

Figure 34:
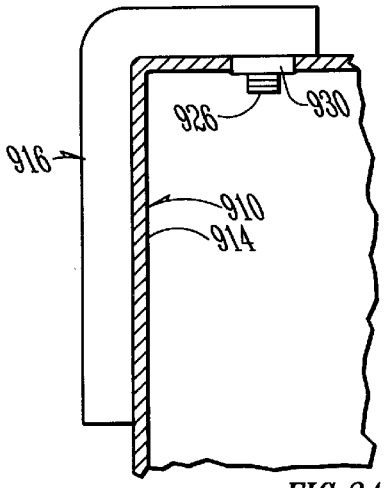
FIG. 34 is an elevational view and partial sectional view showing a still further embodiment of an antenna according to the present invention as applied to a hand-held terminal device.

By referring to FIGS. 34–38, a still further embodiment of the present invention can be seen. FIG. 34 shows in cross section a hand-held transceiver 910 having a hand sized housing 914. An antenna housing 916 is mounted externally but conformally to the shape of terminal housing 914. A connection component 930 serves to connect antenna housing 916 to housing 914, and also provide a connection for the radiating element inside housing 916 to the transceiver components inside housing 914.

Figure 35:
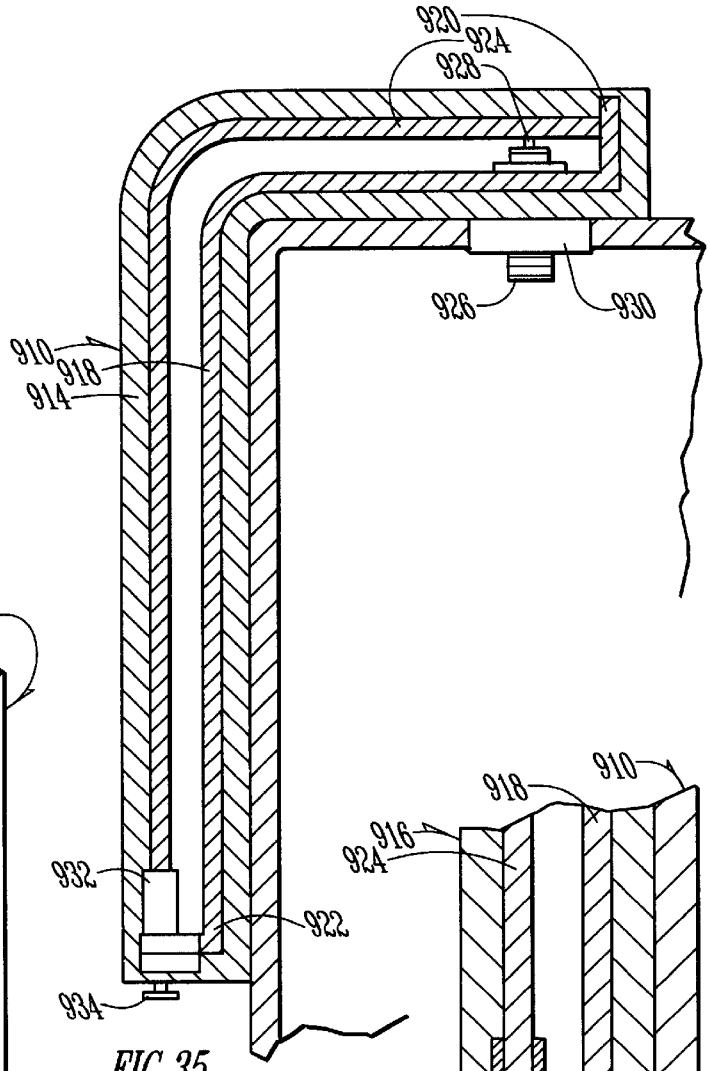
FIG. 35 is an enlarged sectional view of the antenna element of FIG. 34.

FIG. 35 shows in enlarged cross-sectional fashion antenna housing 916. In this embodiment, a bracket 918 having opposite ends 920 and 922 is shaped to fit the interior of housing 916 closest to the terminal housing 914 when mounted thereto. A brass rod 924 comprises the radiating or antenna element and is connected to bracket 918 at end 920 and at end 922. It is spaced apart from bracket 918 and basically closely conforms with the opposite inside surface of antenna housing 916. This arrangement keeps brass rod 924 at a constant height above bracket 918.

By referring to FIG. 36, it can be seen that bracket 918 and element 924 are basically enclosed or encapsulated within antenna housing 916. A threaded SMA slug 926 extends through bracket 918 and antenna housing 916. An antenna feed line 928 is connected to element 924 and extends through the interior of slug 926, which can extend through a nut 930 in terminal case 914 to secure antenna housing 916 to terminal case 914 and also allow it to be connected (by threaded connection or other means) to a wire (not shown) which would connect element 924 to transceiver of the device.

FIG. 37 shows generally how the bracket conforms to the terminal case. This figure shows the antenna cover and the radiating element in ghost lines.

Figure 38:
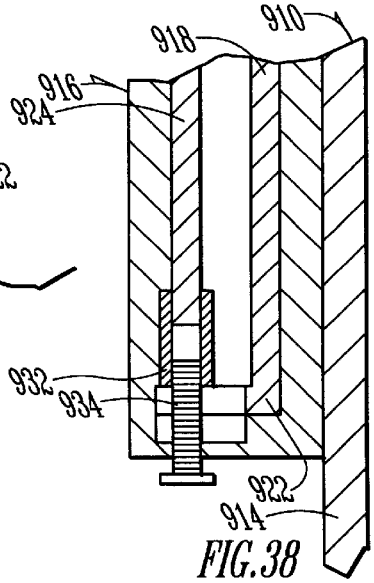
FIG. 38 is an enlarged isolated partial view of one end of the antenna element of FIG. 35.

By referring to FIGS. 35 and 38, it can be seen that a Teflon tube 932 receives one end of the element 924. A metal adjusting slug 934 is threadable through a threaded aperture in the end 922 of bracket 918 and into Teflon tube 932. By turning slug 934, the antenna can be tuned.

Figure 39:
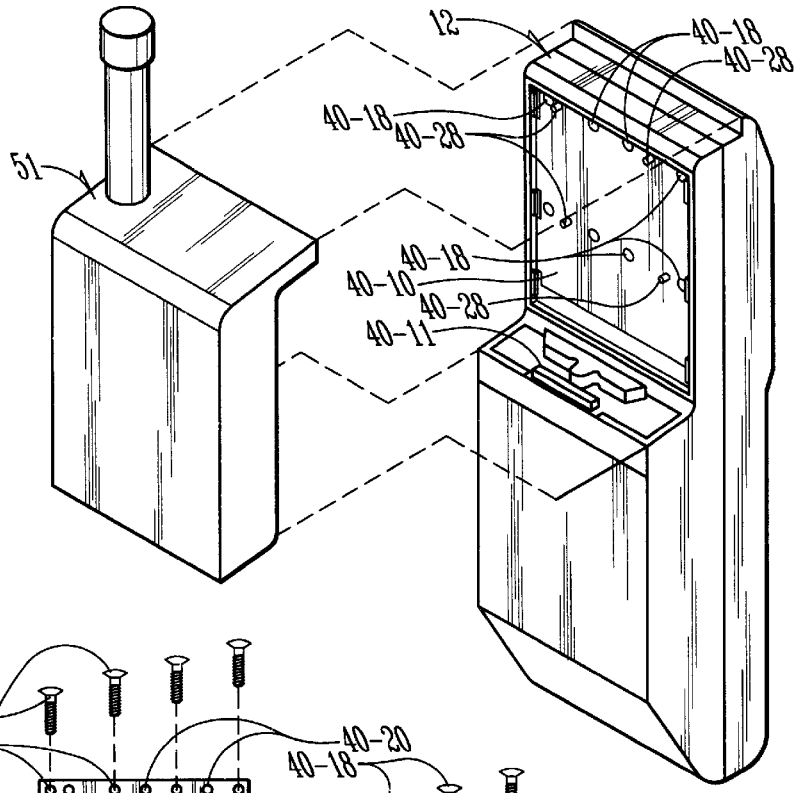
FIG. 39 is a perspective exploded view showing a hand-held terminal with a removable module in a removed position.
Figure 40:
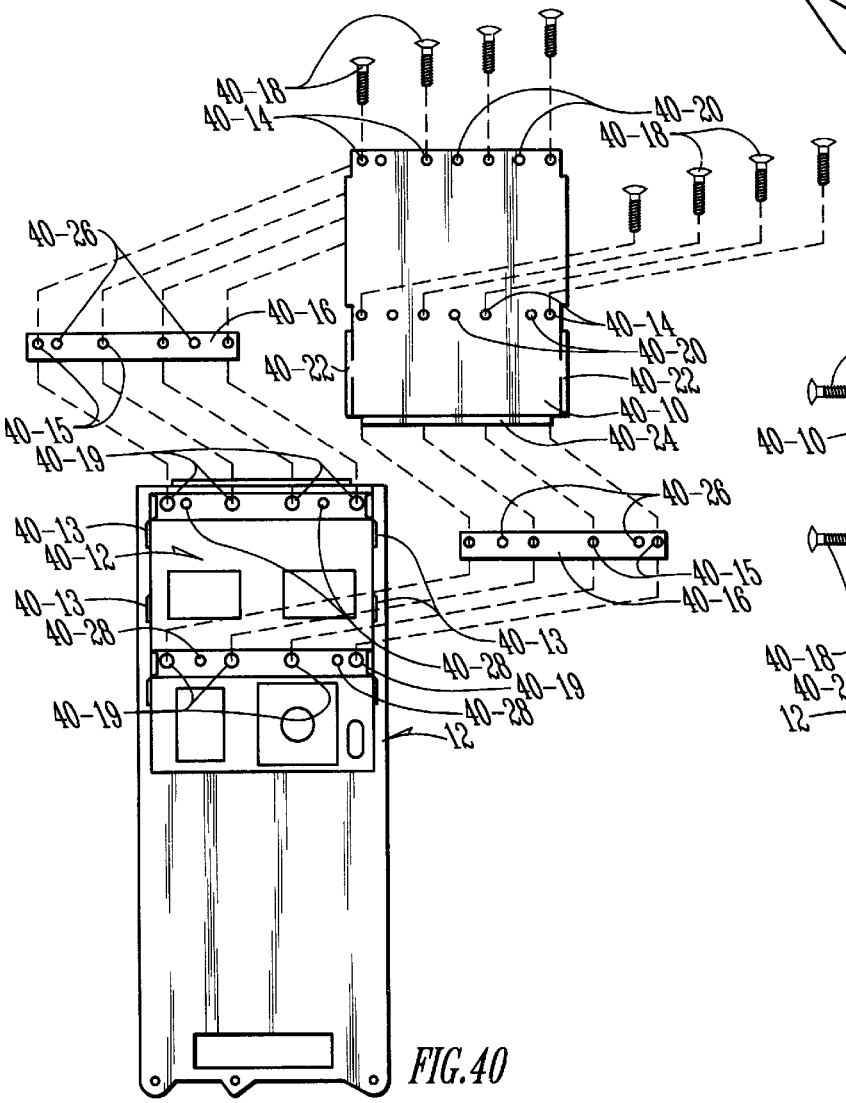
FIG. 40 is a back plan view of the terminal of FIG. 39 with the module removed and with a cover plate and associated securing hardware shown in exploded form.
Figure 41:
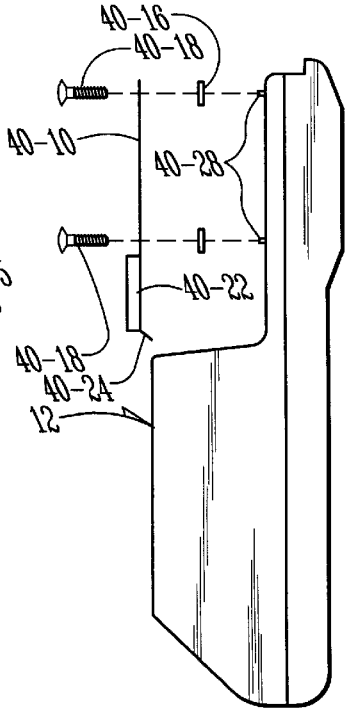
FIG. 41 is a side elevational view of FIG. 40 showing the cover plate in position to be installed.

It can therefore be seen that in this embodiment the antenna element is again encapsulated or enclosed within a housing, and the antenna and housing closely conforms to the shape of the hand-held receiver/transmitter.

j. FIGS. 39–41

By referring to FIGS. 39–41, and also to FIGS. 1–7, it can be seen in some instances it is advantageous to have a hand-held terminal 12 with removable modules such as module 48 or 51 (FIGS. 3 and 4). FIG. 39 shows such an arrangement. Connection and disconnection to terminal 12 of the module (in this instance module 51) electrically is accomplished by, for example, pins on module 51 (not shown) and receiving sockets at 40-11 in FIG. 39, and mechanically by, for example, items 56 (shown in FIG. 4) which mate into receiving slots 40-13 in terminal 12 (see FIG. 40). FIG. 39 also shows that a cover plate 40-10 is installable over the upper back portion of terminal 12. Cover plate 40-10 would eliminate exposure of electrically sensitive electronics in terminal 12 to touching or foreign objects, or otherwise assist in protecting the interior contents of terminal 12 from contact or damage (from, for example, debris or parts falling into terminal 12).

FIG. 39 illustrates cover plate 40-10 is fastened to the back of terminal 12 by screws 40-18. Additionally there are outwardly extending locator pins 40-28 positioned on the back of terminal 12 that mate with locator holes 40-20 (see FIG. 40) in cover plate 40-10 to accurately position cover plate 40-10 on terminal 12.

FIGS. 40 and 41 illustrate in more detail cover plate 40-10 and the dimensions and characteristics which allow it to be installed over the exposed portion (denoted by reference numeral 40-12 in FIG. 40) of terminal 12. FIG. 40 shows that cover plate 40-10 is basically a substantially flat and thin piece of material having two rows of apertures; namely screw holes 40-14 and locator holes 40-20 as indicated. A pair of flat elongated pieces 40-16 are used in conjunction with screws 40-18 to fasten cover plate 40-10 in place on terminal 12.

Flat elongated pieces 40-16 fit along the rows of screw holes 40-19 and locator pins 40-28 in the back of terminal 12. Elongated pieces 40-16 have identically spaced screw holes 40-15 as well as locator holes 40-26 to match up with screw holes 40-19 and locator pins 40-28 in terminal 12 respectively. Elongated pieces 40-16 serve as washers and stiffeners because of the relatively thin nature of cover plate 40-10 and because screws 40-18 pass through elongated pieces 40-16 and screw holes 40-19 and connect with and secure components inside terminal 12 (for example an LCD display on the opposite side of terminal 12).

FIG. 41 shows from a different view the combination of cover plate 40-10, flat pieces 40-16, and screws 40-18. FIG. 41 also shows that locking ears 40-22 at lower opposite sides of cover plate 40-10 are bent obliquely from the plane defined by cover plate 40-10. These locking ears 40-22 are used to snap that portion of cover plate 40-10 into the sides of the back opening 40-12 of terminal 12. They cooperate with bent portion 40-24 to hold cover plate 40-10 in place as well as deter the lower part of cover plate 40-10 from catching on and being pulled away from terminal 12 when a module is removed from terminal 12.

In this preferred embodiment, it can be seen that the shape and configuration of cover plate 40-10 can be specifically manufactured to cover exposed area 40-12 of terminal 12. In the preferred embodiment, cover plate 40-10 is made of rigid vinyl film 0.010 inches thick. Both sides can be smooth. In particular, cover plate 40-10 can be a calendared polyvinylchloride film, white in color with untextured finish. Its physical characteristics are as follows:

Specific gravity: 1.35

Elongation: 25–50%

Tensile Strength: 7,000–10,000 psi (at 25° C.)

Water Absorption: Negligible, 24 hours

Its resistance to heat is as follows:

Continuous surface temperature: 65° C.

Softening temperature: 75°–105° C.

Coefficient of thermal expansion: 7.5×0.00001 inch/inch/°C.

Burn rate: 0.2–1.7 in/second

Its electrical properties are as follows:

Dielectric strength: greater than 425V/mil (at 4 mil, 25° C.)

Dielectric constant: 2.8–3.3 (1 KHz–1 GHz)

Volume resistivity: $10^{16}$ ohm-cubic centimeter

Its standard tolerance of thickness is:

±10%

It is to be understood that cover plate 40-10 can be made of radio energy permeable material if desired, or alternatively, of non-radio energy permeable material, if shielding of the contents of terminal 12 from radio energy is desired.

It can therefore be seen that cover plate 40-10 can be relatively easily inserted over the exposed area 40-12 of the hand-held terminal 12. The combination of parts (cover plate 40-10, pieces 40-16, and screws 40-18) are low profile so they do not interfere with the normal connection and disconnection of a module such as module 51 of FIG. 39 or other modules. Plate 40-10 is also useful in protecting the contents of terminal 12 when no module is attached.

k. Miscellaneous

It can therefore be seen that in the above embodiments, various problems and deficiencies of a helical stub antenna, as conventionally utilized, are remedied. It is to be understood, however, that these are preferred embodiments of the invention only, and are not intended to limit the scope of the invention. The true essence and spirit of the invention are defined in the appended claims and variations obvious to those of ordinary skill in the art are included therein.

What is claimed is:

1. An improved antenna system for a hand-held transceiver terminal having a terminal housing, the improved antenna system comprising:

a radiating element comprising an antenna, and having a connection means for connection to a transceiver circuit;

a second housing enclosing the antenna at least partially; and the second housing closely conforming to the shape of the terminal housing and separating the antenna from the terminal housing.

2. The antenna system of claim 1 wherein the antenna is placed in the terminal at or near walls of the terminal.

3. The antenna system of claim 1 wherein the second housing is placed to conform substantially to the exterior of the terminal.

4. An antenna for use with a portable radio frequency transceiver terminal, the terminal having an interior and exterior and being of a size compatible with hand-held carrying and use comprising:

a terminal housing having operational components in said interior, said operational components including a microprocessor and a transceiver, and having other operational components associated with said exterior, said other operational components including a user interface and display;

an antenna assembly of a size and shape that is substantially smaller than any exterior dimensions of the housing and having at least one radiating element adopted for radio frequency transmission and reception appropriate for the terminal enclosed from direct exposure to the environment around the terminal by material which is substantially radio-energy permeable, the antenna assembly conforming substantially to outer perimeter dimensions of the housing with the material separating the radiating element from the terminal housing.

5. The antenna of claim 4 wherein the radiating element is enclosed in a casing closely surrounding the radiating element.

6. The antenna of claim 5 wherein the casing is attachable to the exterior of the housing.

7. The antenna of claim 5 wherein the casing is positioned in the interior of the housing.

8. The antenna of claim 5 wherein the radiating element consists of two separated elements.

9. The antenna of claim 8 wherein said casing closely surrounds each radiating element.

10. The antenna of claim 5 wherein the terminal housing includes a detachable module and the antenna assembly is contained in the module.

11. The antenna of claim 10 wherein the module includes a frame of substantially rigid material, and a cover of substantially flexible, resilient material covering an opening into the interior of the module, the cover comprising a substantially radio-energy permeable material.

12. The antenna of claim 11 wherein the module includes operating components in addition to the radiating element.

13. A method for eliminating an outwardly extending linear antenna for hand-size portable radio frequency terminals:

encasing in a radio frequency permeable material a substantial portion of a radiating element of a size and shape substantially smaller than the dimensions of the terminal;

placing the encased radiating element in a position relative to the terminal such that the radio frequency permeable material is positioned between the radiating element and the terminal and so that the encased radiating element does not extend substantially from outer perimeter dimensions of the terminal and closely conforms to the shape of the terminal.

14. The method of claim 13 wherein the radiating element is placed externally of the terminal.

15. The method of claim 13 wherein the radiating element is placed internally of the terminal.

16. The method of claim 13 wherein the radiating element is partially external and partially internal of the terminal.

17. The method of claim 13 wherein the radiating element is configured to perform substantially equivalently to an outwardly extending linear antenna.

18. An antenna assembly for a portable data terminal having a palm-size, generally rectangular-in-cross-section housing comprising:

an antenna casing having an interior surface and an exterior surface with at least a portion of the exterior surface relatively closely conforming to at least one surface of the housing of the terminal;

a radiating element inside the casing having first and second ends electrically isolated from one another other than by the radiating element itself, with the radiating element being separated from the housing of the terminal by the antenna casing;

a mounting component connecting the casing to the housing and allowing electrical connection of the radiating element to a transceiver device in the housing.

19. The antenna assembly of claim 18 further comprising a tuning means associated with the radiating element.

20. A module including a radio frequency transceiver for removable inter-connection to a hand-held terminal comprising:

a module housing having an internal portion and an external portion, walls and adjacent surfaces, and including at least one operational component in the interior;

a transceiver disposed in the internal portion of the module housing;

an antenna assembly including a radiating element disposed at the external portion of the housing and connected between the radiating element and the transceiver, the radiating element conforming closely to at least some of the walls and adjacent surfaces of the module housing; and a cover member over the external portion of the module housing, the cover comprising a substantially radio frequency permeable material.

21. The radio frequency module of claim 20 wherein the cover member is made of a material which is resilient to deter damage if abutted with other objects without damage to the module or terminal, and yet rigid enough to be durable and at the same time allowing radio frequency energy to permeate the material.

22. A hand-held terminal having an interior and exterior and being of a size compatible with hand-held carrying and use, comprising:

a terminal housing having a portion substantially open to its interior and including at least one operational component in the interior;

a module device including a module housing removably insertable over the substantially open portion of the terminal housing;

cooperating connection members in the terminal housing and module housing to allow releasable connection of the module housing to the terminal housing; and a cover member positioned over the substantially open portion in the terminal housing to cover the operational component in the interior of the terminal housing, wherein the cover member is positioned between the terminal housing and the module housing when the terminal housing and module housing are connected together.

23. The terminal of claim 22 wherein the cover member is made of a thin but relatively rigid material.

24. The terminal of claim 22 wherein the cover member is connectable to the terminal by releasable fasteners.

25. The terminal of claim 22 wherein the cover member includes locator holes at predetermined positions which matingly fit over locator pins extending from the terminal housing.

26. The terminal of claim 25 further comprising a relatively rigid piece having apertures lining up with the locator holes in the cover member, the piece being positionable between the cover member and the terminal housing.

27. An antenna for use with a portable radio frequency transceiver terminal, the terminal having an interior and exterior and being of a size compatible with hand-held carrying and use comprising:

a terminal housing having operational components in said interior, said operational components including a microprocessor and a transceiver, and having other operational components associated with said exterior, said other operational components including a user interface and display;

an antenna assembly of a size and shape that is substantially smaller than any exterior dimensions of the housing and having at least one radiating element enclosed in a casing closely surrounding the radiating element and adapted for radio frequency transmission and reception appropriate for the terminal enclosed from direct exposure to the environment around the terminal by material which is substantially radio-energy permeable, the antenna assembly conforming substantially to outer perimeter dimensions of the housing wherein the casing is positioned in the interior of the housing.

28. An antenna for use with a portable radio frequency transceiver terminal, the terminal having an interior and exterior and being of a size compatible with hand-held carrying and use comprising:

a terminal housing having operational components in said interior, said operational components including a microprocessor and a transceiver, and having other operational components associated with said exterior, said other operational components including a user interface and display;

an antenna assembly of a size and shape that is substantially smaller than any exterior dimensions of the housing and having at least one radiating element enclosed in a casing closely surrounding the radiating element and adopted for radio frequency transmission and reception appropriate for the terminal enclosed from direct exposure to the environment around the terminal by material which is substantially radio-energy permeable, the antenna assembly conforming substantially to outer perimeter dimensions of the housing, wherein the radiating element consists of two separated elements.

29. The antenna of claim 28 wherein said casing closely surrounds each radiating element.

* * * * *

UNITED STATES PATENT AND TRADEMARK OFFICE

CERTIFICATE OF CORRECTION

PATENT NO. : 5,841,402
APPLICATION NO. : 08/711287
DATED : November 24, 1998
INVENTOR(S) : Daniel R. Dias et al.

It is certified that error appears in the above-identified patent and that said Letters Patent is hereby corrected as shown below:

Item [63]
"Continuation of Ser. No. 19,481, Feb. 18, 1993, Pat. No. 5,555,459, which is a continuation-in-part of Ser. No. 859,510, Mar. 27, 1992" should read -- Continuation of Ser. No. 19,481, Feb. 18, 1993, Pat. No. 5,555,459, which is a continuation-in-part of Ser. No. 859,570, Mar. 27, 1992 --.

Signed and Sealed this

Seventh Day of September, 2010

David J. Kappos

David J. Kappos
*Director of the United States Patent and Trademark Office*